US010889396B2

(12) United States Patent
Park

(10) Patent No.: US 10,889,396 B2
(45) Date of Patent: Jan. 12, 2021

(54) VEGETABLE BINDING PACKING MATERIAL HAVING AIR COLUMNS, VEGETABLE BINDING PACKING DEVICE USING SAME, AND METHOD THEREFOR

(71) Applicant: Sangjo Park, Gyeonggi-do (KR)

(72) Inventor: Sangjo Park, Gyeonggi-do (KR)

( * ) Notice: Subject to any disclaimer, the term of this patent is extended or adjusted under 35 U.S.C. 154(b) by 182 days.

(21) Appl. No.: 15/779,083

(22) PCT Filed: Sep. 6, 2016

(86) PCT No.: PCT/KR2016/009986

§ 371 (c)(1),
(2) Date: May 24, 2018

(87) PCT Pub. No.: WO2017/090870

PCT Pub. Date: Jun. 1, 2017

(65) Prior Publication Data

US 2018/0354666 A1 Dec. 13, 2018

(30) Foreign Application Priority Data

Nov. 25, 2015 (KR) ..... 10-2015-0165735
Nov. 25, 2015 (KR) ..... 10-2015-0165742
Nov. 25, 2015 (KR) ..... 10-2015-0165747

(51) Int. Cl.
*B65B 25/04* (2006.01)
*B65B 11/02* (2006.01)
(Continued)

(52) U.S. Cl.
CPC ..... *B65B 25/041* (2013.01); *B65B 11/02* (2013.01); *B65B 25/02* (2013.01); *B65B 27/10* (2013.01);
(Continued)

(58) Field of Classification Search
CPC ..... B65D 65/22; B65D 75/02; B65D 85/50; B65D 67/00; B65D 81/03; B65B 25/041;
(Continued)

(56) References Cited

U.S. PATENT DOCUMENTS 2,624,990 A * 1/1953 Allen ..... B65B 11/02 53/77
2,865,153 A * 12/1958 Seragnoli ..... B65B 11/02 53/466
(Continued)

FOREIGN PATENT DOCUMENTS

JP 8-230945 9/1996
JP 10-513141 12/1998
(Continued)

OTHER PUBLICATIONS

International Search Report for PCT/KR2016/009986 dated Dec. 12, 2016 and its English translation from WIPO.
(Continued)

*Primary Examiner* — Thomas M Wittenschlaeger
(74) *Attorney, Agent, or Firm* — Ladas & Parry, LLP

(57) ABSTRACT

Provided are a new concept vegetable binding packing material having an air column, suitable for protecting vegetables, a new concept vegetable binding packing device for binding vegetables using the same, and a packaging method therefor. A vegetable binding packing material including an air column includes: at least one air column disposed in a row to surround a certain amount of vegetables in a direction crossing a lengthwise direction of the vegetables; and a bonding portion configured to bond both ends from the at least one air column to the outside of the vegetables. A vegetable binding packing device according to the present disclosure includes: a packing material supply unit configured to feed a packing material; a clamp injection module including a clamping unit configured to clamp a front
(Continued)

portion of the packing material and an injection unit configured to inject air into an air column pattern; a vegetable supply unit configured to supply vegetables; and a sealing module configured to seal a portion of the air column pattern across the air column pattern injected with air.

6 Claims, 23 Drawing Sheets

(51) Int. Cl.

| | |
|---|---|
| ***B65B 41/16*** | (2006.01) |
| ***B65B 51/22*** | (2006.01) |
| ***B65D 75/02*** | (2006.01) |
| ***B65D 81/03*** | (2006.01) |
| ***B65D 85/50*** | (2006.01) |
| ***B65D 67/00*** | (2006.01) |
| ***B65D 65/22*** | (2006.01) |
| ***B65B 25/02*** | (2006.01) |
| ***B65B 27/10*** | (2006.01) |
| *B65B 51/14* | (2006.01) |

(52) U.S. Cl.
CPC ..... *B65B 41/16* (2013.01); *B65D 65/22* (2013.01); *B65D 67/00* (2013.01); *B65D 75/02* (2013.01); *B65D 81/03* (2013.01); *B65B 51/14* (2013.01); *B65B 51/225* (2013.01); *B65D 85/50* (2013.01)

(58) Field of Classification Search
CPC ..... B65B 25/02; B65B 11/02; B65B 51/225; B65B 51/14; B65B 51/10; B65B 41/16; B65B 41/12; B65B 27/10; B65B 7/02; B65B 31/00; B65B 31/048; B65B 61/00; B65B 43/465; B31D 5/0073; B31D 2205/0047
See application file for complete search history.

(56) References Cited

U.S. PATENT DOCUMENTS

| | | | | | |
|---|---|---|---|---|---|
| 3,942,298 | A * | 3/1976 | Matzinger | B65B 25/24 | 53/409 |
| 4,012,890 | A * | 3/1977 | Bauer | B65B 11/10 | 53/586 |
| 4,509,314 | A * | 4/1985 | Bozza | B65B 11/10 | 53/228 |
| 5,115,620 | A * | 5/1992 | Takamura | B65B 57/00 | 53/222 |
| 5,186,989 | A * | 2/1993 | Tsukada | B29C 65/02 | 156/290 |
| 5,205,104 | A * | 4/1993 | Nakashima | B65B 11/54 | 53/389.2 |
| 5,733,652 | A * | 3/1998 | Stowman | B65D 63/1009 | 156/60 |
| 6,085,487 | A * | 7/2000 | De Vlaam | B65B 27/08 | 100/17 |
| 6,375,785 | B1 * | 4/2002 | Aquarius | B31D 5/0073 | 156/252 |
| 7,669,386 | B2 * | 3/2010 | Liao | B31D 5/0073 | 53/525 |
| 7,926,507 | B2 * | 4/2011 | Wetsch | B31D 5/0073 | 137/223 |
| 9,776,747 | B2 * | 10/2017 | Takahashi | B65B 41/16 | |
| 9,844,911 | B2 * | 12/2017 | Corbin | B29C 66/91423 | |
| 9,919,822 | B2 * | 3/2018 | Yoshikane | B65B 31/048 | |
| 2004/0031242 | A1 * | 2/2004 | Cerf | B65B 11/10 | 53/442 |
| 2014/0250834 | A1 * | 9/2014 | Yoshikane | B65B 31/048 | 53/403 |
| 2017/0072655 | A1 * | 3/2017 | Aquarius | B31D 5/0073 | |
| 2018/0354694 | A1 * | 12/2018 | Goto | B65B 11/50 | |

FOREIGN PATENT DOCUMENTS

| | | |
|---|---|---|
| JP | 2008-50022 | 3/2008 |
| KR | 10-0971604 | 7/2010 |
| KR | 10-1047806 | 7/2011 |
| KR | 10-2011-0110415 | 10/2011 |
| KR | 10-1342327 | 12/2013 |
| KR | 10-1542686 | 8/2015 |
| KR | 10-1707004 | 2/2017 |
| KR | 10-1707006 | 2/2017 |
| KR | 10-2017-0060951 | 6/2017 |

OTHER PUBLICATIONS

Written Opinion of the International Searching Authority for PCT/KR2016/009986 dated Dec. 12, 2016 and its English machine translation by Google Translate.
Notice of Allowance dated Feb. 2, 2017 for Korean Patent Application No. 10-2015-0165747 and its English translation from Global Dossier (now issued as Korean Patent No. 10-1707006).
Notice of Allowance dated Feb. 2, 2017 for Korean Patent Application No. 10-2015-0165742 and its English translation from Global Dossier (now issued as Korean Patent No. 10-1707004).
Office Action dated Jan. 19, 2017 for Korean Patent Application No. 10-2015-0165735 and its English translation from Global Dossier (now published as Korean Publication No. 10-2017-0060951).
Final Office Action dated Aug. 25, 2017 for Korean Patent Application No. 10-2015-0165735 and its English translation from Global Dossier (now published as Korean Publication No. 10-2017-0060951).

* cited by examiner (a)

(b)

VEGETABLE BINDING PACKING MATERIAL HAVING AIR COLUMNS, VEGETABLE BINDING PACKING DEVICE USING SAME, AND METHOD THEREFOR

CROSS-REFERENCE TO RELATED APPLICATIONS

This application is the U.S. National Stage of International Patent Application No. PCT/KR2016/009986 filed on Sep. 6, 2016, which claims the priority to Korean Patent Application No. 10-2015-0165735 filed in the Korean Intellectual Property Office on Nov. 25, 2015, Korean Patent Application No. 10-2015-0165742 filed in the Korean Intellectual Property Office on Nov. 25, 2015 and Korean Patent Application No. 10-2015-0165747 filed in the Korean Intellectual Property Office on Nov. 25, 2015, the entire contents of which are incorporated herein by reference.

TECHNICAL FIELD

The present disclosure relates to a VEGETABLE BINDING PACKING MATERIAL for packing vegetables such as leeks, spinach, green onions, and Chinese cabbages in a bundle unit, a vegetable binding packing device using the same, and a vegetable binding packing method using the same.

BACKGROUND ART

Vegetables, in particular, leaf vegetables such as leek, spinach, green onions, Chinese cabbages, and radishes are distributed and sold in a state of being bounded and packed in a bundle unit. As a result, these vegetables are bound with a string-shaped packing material in a producing area and are stored or shipped. As described above, a binding wire provided with a wire is mainly used as the string-shaped packaging material for binding the vegetables as described above. Korean Patent Nos. 10-1047806, 10-1342327, and 10-1542686 disclose examples of the binding wire provided with the wire. The binding wire provided with the wire is manually tied in a producing area by a worker or is automatically tied by a machine.

However, vegetables themselves contain a lot of water and are exposed to a humid environment during distribution. Thus, the wire provided in the binding wire is easily rusted, and the rust of the wire easily permeates the vegetables. In addition, most vegetables are very vulnerable to pressure, thus while tying the binding wire which is binding the vegetables or while grasping the binding wire to move the vegetables, the vegetables are frequently damaged due to the pressure concentrated on a portion adjacent to the binding wire.

On the other hand, as quality of agricultural products is upgraded like organic agricultural products, packaging of vegetables is also upgraded. The typical example of the packing is three-side packing. The three-side packing is performed using a film having transparent front and rear surfaces, and three edges thereof are closed, and one edge thereof is opened. In general, a bundle of vegetables is put in a three-side packing material bound with the binding wire. However, in this case, operations of binding vegetables into a bundle with the binding wire and putting the bundle in the three-side packaging material are required, and it takes a lot of time and effort to pack the vegetables.

On the other hand, productivity of an operation of packing vegetables is very important. Since a time in which freshness of vegetables is maintained is very short without a facility such as a refrigeration facility, the value of the vegetables may drop when the packaging operation of the vegetables takes a long time.

In addition, since the cost of vegetables is relatively low compared to the weight and volume of the vegetables, there is a limitation in that a lot of cost and effort cannot be spent to pack the vegetables.

DISCLOSURE

Technical Problem

Various embodiments are directed to provide a VEGETABLE BINDING PACKING MATERIAL capable of fundamentally preventing damage of vegetables caused by rust generation, by excluding a wire therefrom and preventing damage caused by pressure, by allowing high pressure not to be applied to a portion of vegetables contacting a packing material, and suitable for automation of a vegetable packing process. Various embodiments are directed to provide a vegetable binding packing material capable of binding vegetables and performing three-side packing without a separate pre-binding operation.

Various embodiments are directed to provide a new concept vegetable binding packing device for binding vegetables using a new concept vegetable binding packing material having an air column, suitable for protecting vegetables, and a packaging method therefor. Various embodiments are directed to improve quality of vegetable packing and operation productivity by organically combining a characteristic air injection operation or the like to basic elements of a packing operation, i.e., a packing material supply operation and a binding operation.

Technical Solution

In an embodiment, a vegetable binding packing material includes: at least one air column disposed in a row to surround a certain amount of vegetables in a direction crossing a lengthwise direction of the vegetables; and a bonding portion configured to bond one side end and the other side end of the at least one air column. The bonding portion may be a portion in which both ends extending from the at least one air column to the outside of the vegetables are bonded to each other. The vegetable binding packing material may further include a skirt part which extends from the at least one air column in the lengthwise direction of the vegetables.

The skirt part may include a first skirt part extending from the at least one air column to a first end in the lengthwise direction of the vegetables and a second skirt part extending from the at least one air column to a second end in the lengthwise direction of the vegetables.

One of the first and second skirt parts is disposed to cover an outer surface of the at least one air column and an inlet exposure part configured to expose an air inlet of the at least one air column is formed in the one of the first and second skirt parts, corresponding to the air inlet of the at least one air column.

At least one of the first and second skirt parts may extend beyond an end of the vegetables in the lengthwise direction of the vegetables, and extended portions of the at least one of the first and second skirt parts are bonded to form pack the vegetables through three-side packing or partial three-side packing of the vegetables. The at least one air column may have at least one node having a relatively narrow cross-sectional area perpendicular to a lengthwise direction thereof.

The vegetable binding packing material may include a plurality of air columns disposed in a plurality of rows to surround the certain amount of the vegetables in the direction crossing the lengthwise direction of the vegetables.

In another embodiment, a vegetable binding packing material having an air column, includes: a plurality of unit vegetable binding packing materials which are continuously disposed and each bind a bundle of vegetables, wherein each of the plurality of unit vegetable binding packing materials includes at least one air column disposed in a row to surround a certain amount of the vegetables in a direction crossing a lengthwise direction of the vegetables; and a bonding portion configured to bond both ends extending from the at least one air column to the outside of the vegetables.

The vegetable binding packing material may further include a skirt part which extends from the at least one air column in the lengthwise direction of the vegetables.

In the plurality of unit vegetable binding packing materials continuously disposed, an air column of any one unit vegetable binding packing material and an air column of a unit vegetable binding packing material adjacent thereto may communicate with each other before packing and may be blocked from each other by the bonding portion.

In another embodiment, a vegetable binding packing device includes: a packing material supply unit configured to feed a packing material having an air column pattern formed between double-layered films; a clamp injection module having a clamping part configured to clamp a front portion of the packing material and an injection part configured to inject air into the air column pattern; a vegetable supply unit configured to supply vegetables to be packed, to a middle portion between a front portion and a rear portion of the packing material in a direction crossing the packing material in a state in which the front portion is supported by the clamp injection module and the rear portion is supported by the packing material supply unit; and a sealing module configured to pressurize and support the front portion and the rear portion of the packing material such that the front portion and the rear portion overlap each other to surround the vegetables, and to seal a portion of the air column pattern across the air column pattern injected with air.

The clamp injection module may include a pair of clamp jaws configured to clamp the front portion of the packing material; and an injection needle disposed between the pair of clamp jaws and inserted between the double-layered films. In this case, an end of the injection needle may be inclined in one direction and inserted into the air column pattern by widening a space between the double-layered films. In addition, the injection needle may be inserted between the double-layered films while the pair of clamp jaws clamps the front portion of the packing material.

The sealing module may include a sealing head configured to pressurize and bond overlapped portions (bonding portions) of the packing material; a pair of sealing guides disposed at front and rear sides of the sealing head to pressurize and support both sides of the bonding portions; and an air blocking part disposed between the sealing head and the sealing guide at the rear side among the pair of sealing guides to pressurize and block the air column pattern before a bonding operation of the sealing head. In this case, the pair of sealing guides may have a groove corresponding to the air column pattern, and air may be injected into the air column pattern through the groove in a state in which the pair of sealing guides pressurize and support the packing material. In addition, the sealing head may weld the bonding portions of the packing material. The sealing head may heat-weld the bonding portions of the packing material and may pull back in a state in which the pair of sealing guides and the air blocking part pressurize and support the both sides of the bonding portions, so as to promote air cooling of the bonding portions.

The packing material supply unit may supply discontinuous sheet-shaped packing material or a continuous-roll-shaped packing material. When the packing material supply unit supplies the continuous-roll-shaped packing material, the clamp injection module may include an injection needle corresponding to each of air columns of the continuous-roll-shaped packing material.

In another embodiment, a vegetable binding packing method includes: a packing material preparing operation of preparing a vegetable binding packing material comprising an air column pattern formed between double-layered films; a packing material supplying operation of feeding the vegetable binding packing material a certain distance in a lengthwise direction of the air column pattern; a vegetable supplying operation of supplying vegetables to a middle portion between a front portion and a rear portion of the vegetable binding packing material in a state in which the front portion and the rear portion are supported, and allowing the vegetable binding packing material to surround the vegetables in a state in which a lengthwise direction of the vegetables crosses a lengthwise direction of the vegetable binding packing material; and an air injecting and bonding operation of supporting the front portion and the rear portion of the vegetable binding packing material such that portions of the front and rear portions overlap each other, injecting air into the air column pattern to form an air column surrounding the vegetables, and bonding the overlapped portions.

In the packing material preparing operation, a vegetable binding packing material may be prepared in a discontinuous shape or a continuous roll shape, the vegetable binding packing material comprising an air column pattern in a row or air column patterns in a plurality of rows according to a lengthwise direction thereof.

In the packing material supplying operation, the front portion of the vegetable binding packing material may be clamped in a state in which an injection needle for injecting air is inserted into the air column pattern.

In the packing material preparing operation, a vegetable binding packing material having air column patterns in a plurality of rows may be prepared in a continuous roll shape, and in the packing material supplying operation, the front portion of the vegetable binding packing material may be clamped in a state in which an injection needle for injection air is inserted into the air column pattern.

The air injecting and bonding operation may include an air injecting operation of injecting the air into the air column pattern to form the air column surrounding the vegetables in a state in which front and rear sides of bonding portions, i.e., portions of front and rear portions of the packing material are fixedly supported; and a bonding operation of bonding the bonding portions by using a welding head in a state in which air is blocked between the bonding portions and a peripheral portion of the vegetables.

The welding head may contact the bonding portions to heat and weld the bonding portions and may be separated from the bonding portions such that the bonding portions are cooled.

In the packing material preparing operation, a vegetable binding packing material having a skirt part may be prepared, the skirt part extending from at least one side of the air column pattern and the air column in a widthwise direction of the air column pattern and the air column. In the packing material preparing operation, a vegetable binding packing material having a skirt part may be prepared, the skirt part extending beyond an end in a lengthwise direction of the vegetables, and in the air injecting and bonding operation, a bonding portion may be formed along a peripheral portion of the skirt part. In addition, the vegetables may be bound and peripheral portions of the vegetable binding packing material may be bonded in a state in which a certain amount of the vegetables are placed in the vegetable binding packing material.

In the packing material preparing operation, double-layered skirt parts are formed by extending an inner film and an outer film from at least one side of the air column pattern in a widthwise direction of the air column pattern, and the outer film of the double-layered skirt parts is folded to cover an outer surface of the air column.

Advantageous Effects

Due to such as configuration, a vegetable binding packing material having an air column according to the present disclosure may fundamentally prevent damage of vegetables caused by rust generation by excluding a wire therefrom. In addition, the vegetable binding packing material may prevent damage caused by pressure by allowing high pressure not to be applied to a portion of vegetables contacting a packing material. In addition, the vegetable binding packing material is suitable for automation of a vegetable packing process.

Unlike a general air injection packing material, since the vegetable binding packing material having the air column according to the present disclosure has a structure capable of preventing air from escaping from the air column due to the air column being damaged from the outside, the vegetable binding packing material is more faithful to protect contents, i.e., the vegetables and has a shape favorable to the packing of vegetables of which a volume of a root is greater than a volume of a leaf.

In addition, according to an aspect of the present disclosure, vegetables may be bound and three-side packing may be performed without a separate pre-binding operation, thereby saving a time and costs required to pack high-quality vegetables.

Furthermore, according to the present disclosure, provided are a vegetable binding packing device for binding vegetables using a new concept vegetable binding packing material having an air column, suitable for protecting vegetables, and a packaging method therefor. In addition, quality of vegetable packing and operation productivity may be improved by organically combining a characteristic air injection operation or the like to basic elements of a packing operation, i.e., a packing material supply operation and a binding operation.

MODE FOR INVENTION

Hereinafter, embodiments of the present disclosure will be described with reference to the accompanying drawings.

The following embodiments may be modified in various ways and the range of the present disclosure is not limited to the following embodiments. Embodiments of the present disclosure are provided to clearly give the technical spirit of the present disclosure to those skilled in the art.

Figure 1:
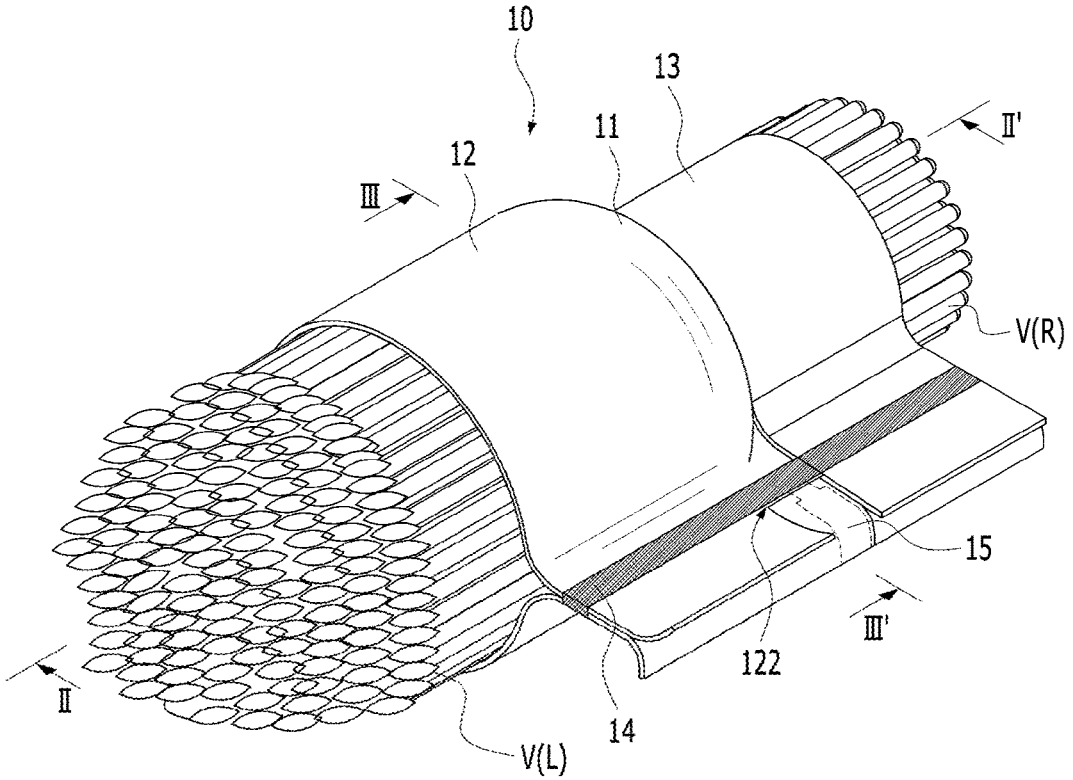
FIG. 1 illustrates that vegetables are packed using a vegetable binding packing material according to an embodiment of the present disclosure.

FIG. 1 illustrates that vegetables V are packed using a vegetable binding packing material 10 according to an embodiment of the present disclosure.

The vegetable binding packing material 10 according to the present embodiment includes an air column 11 disposed in a row so as to surround a certain amount of the vegetables V in a direction crossing a lengthwise direction of the vegetables V and a bonding portion 14 configured to bond one side end of the air column 11 and the other side end opposite to the one side end. The bonding portion 14 may have, for example, a structure in which both ends thereof extending from the air column 11 to the outside of the vegetables V are bonded to each other. The air column 11 may have a constant cross-sectional area according to a lengthwise direction thereof or may have one or more nods having a relatively narrow cross-sectional area. In addition, the air column 11 may include a plurality of air columns in which air does not flow therebetween.

Meanwhile, the bonding portion 14 may be formed in a shape different from the above-described shape. For example, when one side end of the air column 11 and the other side end opposite to the one side end overlap each other, the bonding portion 14 may be formed in a shape in which an inner surface of an outer end thereof and an outer surface of an inner end thereof are bonded to each other.

According to the present embodiment, the vegetable binding packing material 10 further includes skirt parts 12 and 13 extending from the air column 11 in a lengthwise direction of the vegetables V. The skirt parts 12 and 13 may have a first skirt part 12 extending from the air column 11 to a first end, i.e., leaves VL of the vegetables V in the lengthwise direction of the vegetables V and a second skirt part 13 from the air column 11 to a second end, i.e., stems or roots VR of the vegetables V in the lengthwise direction of the vegetables V.

In this case, any one of the first and second skirt parts 12 and 13, i.e., in the present embodiment, the first skirt part 12 may be disposed to surround an outer surface of the air column 11. Since the first skirt part 12 surrounds the outer surface of the air column 11, the first skirt part 12 may be provided to have an inside diameter greater than that of the second skirt part 13. Such a shape is very suitable to pack vegetables in which a volume of leaves is generally greater than that of roots. The vegetable binding packing material 10 according to the present disclosure may provide a uniformly dispersed binding force without applying high pressure to a portion of vegetables while surrounding and protecting the vegetables in a wider range, compared to an existing packing material having a binding wire shape. However, the first skirt part 12 may cover the air column 11 to cover an air inlet 15 used to inject air into the air column 11, and thus, the first skirt part 12 may form an obstacle to automation of a process of binding and packing a vegetable. According to the present embodiment, an inlet exposure part 122 configured to expose the air inlet 15 to the outside may be formed in a portion at one side of the first skirt part 12, corresponding to the air inlet 15, thereby solving the obstacle.

A cross-sectional area perpendicular to the lengthwise direction of the air column 11 may have an overall constant size, and the air column 11 may have one or more nodes formed to have a relatively narrow width.

Figure 2:
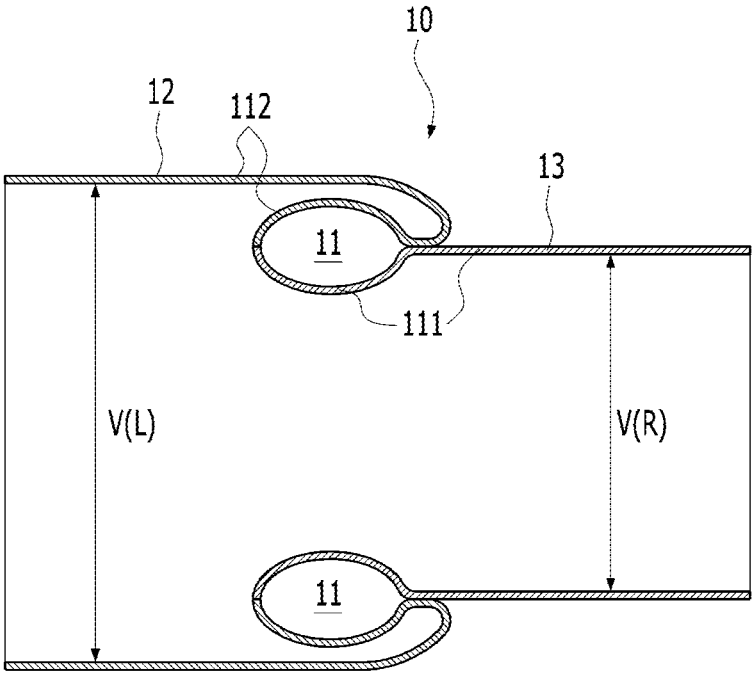
FIG. 2 is a cross-sectional view taken along line II-II' of the vegetable binding packing material according to the embodiment of FIG. 1.

FIG. 2 is a cross-sectional view taken along line II-II' of the vegetable binding packing material 10 according to the embodiment of FIG. 1.

FIG. 2 illustrates a cross section obtained by cutting the vegetable binding packing material 10 in a direction perpendicular to the air column 11. The vegetables V are omitted. The vegetable binding packing material 10 may be composed of a transparent or opaque film. For example, the vegetable binding packing material 10 may include an inner film 111 contacting the vegetables V and an outer film 112 opposite to the inner film 111. The inner film 111 and the outer film 112 may be integrally connected or bonded to each other at one side of the air column 11. The inner film 111 and the outer film 112 are bonded (attached, welded, or ultrasonically bonded) to each other to form the air column 11 having a long air chamber.

In the present embodiment, the second skirt part 13 may be disposed in a form in which the inner film 111 extends from one side of the air column 11 to the stems or roots VR of the vegetables V. The first skirt part 12 may be disposed in a form in which the outer film 112 extending from the air column 11 in the same direction as the second skirt part 13 is folded in the direction of the leaves VL of the vegetables V. Due to such a placement, the first skirt part 12 functions to protect the leaves VL of the vegetables V and also functions to prevent air from escaping from the air column 11 by preventing the air column 11 from being bricked by an external sharp object or being damaged by friction with a rough object. In addition, since the first skirt part 12 surrounds an outer surface of the air column 11 expanded due to air being injected thereto, the first skirt part 12 may have the inside diameter greater than that of the second skirt part 13 to surround relatively voluminous leaves of vegetables.

Figure 3:
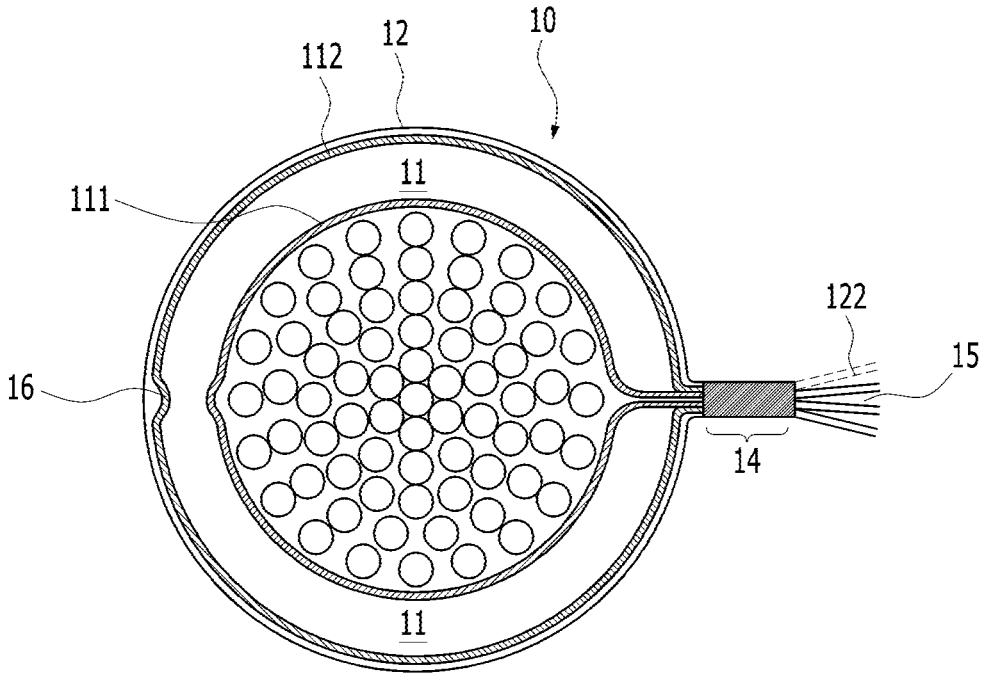
FIG. 3 is a cross-sectional view taken along line III-III' of the vegetable binding packing material according to the embodiment of FIG. 1.

FIG. 3 is a cross-sectional view taken along line III-III' of the vegetable binding packing material 10 according to the embodiment of FIG. 1.

Referring to FIG. 3, the relationship between the air inlet 15, the air column 11, and the bonding portion 14 may be easily understood. As described above, the air column 11 is formed in the form of the long air chamber by a connection or bonding pattern of the inner film 111 and the outer film 112, and one end of the air column 11 is connected to the air inlet 15. On the other hand, a portion of the air column 11 may be provided as a nod 16 having a narrow cross-sectional area. The nod 16 allows a bundle of vegetables to take an overall constant shape.

In order to more clearly understand the configuration of the vegetable binding packing material 10 according to the present embodiment, a process of binding and packing vegetables by using the vegetable binding packing material 10 will be described. After a certain amount of vegetables surrounded by the vegetable binding packing material 10 before air is injected into the vegetable binding packing material 10, when air is injected through the air inlet 15, the air column 11 is formed, and a shape of a package is constantly maintained by pressure of the air column 11. The air column 11 is easily bent at the above-described nod 16, and the remainder of the air column 11 constitutes a form of a curve along a peripheral surface of vegetables. When heat and pressure are applied to the bonding portion 14 in such a state, the bonding portion 14 is welded to seal the air column 11, and the above-described second and third skirt parts 12 and 13 are welded to each other to complete packing. When air is injected into the air column 11, a nozzle of a compressor needs to be inserted by widening a space between a portion of the inner film 111 and a portion of the outer film 112, corresponding to the air inlet 15. Such a process may be automated by forming the inlet exposure part 122 having a shape formed by partially omit the first skirt part 12 such that the air inlet 15 is exposed.

Figure 4:
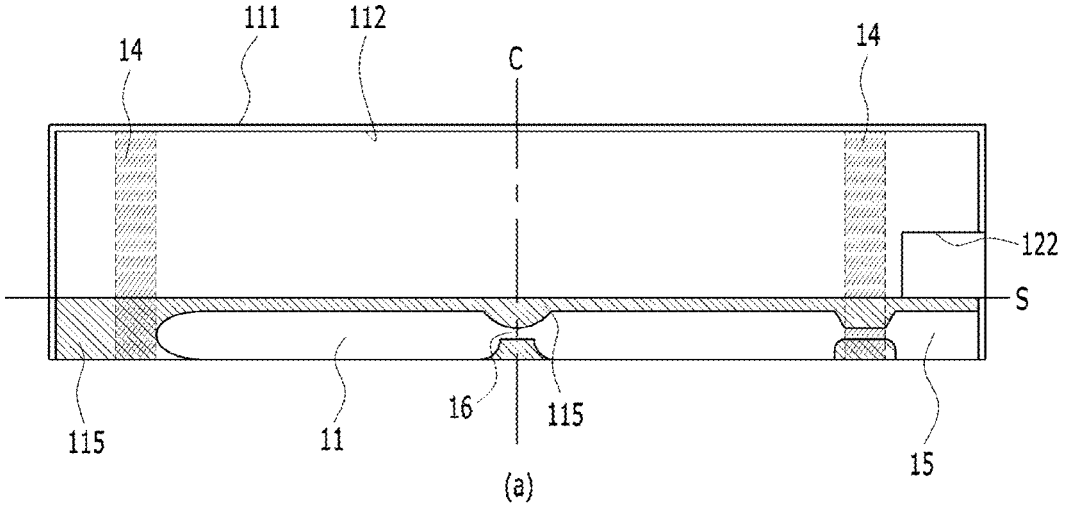
FIG. 4 illustrates a state before packing of a vegetable binding packing material according to an embodiment of the present disclosure.
Figure 4:
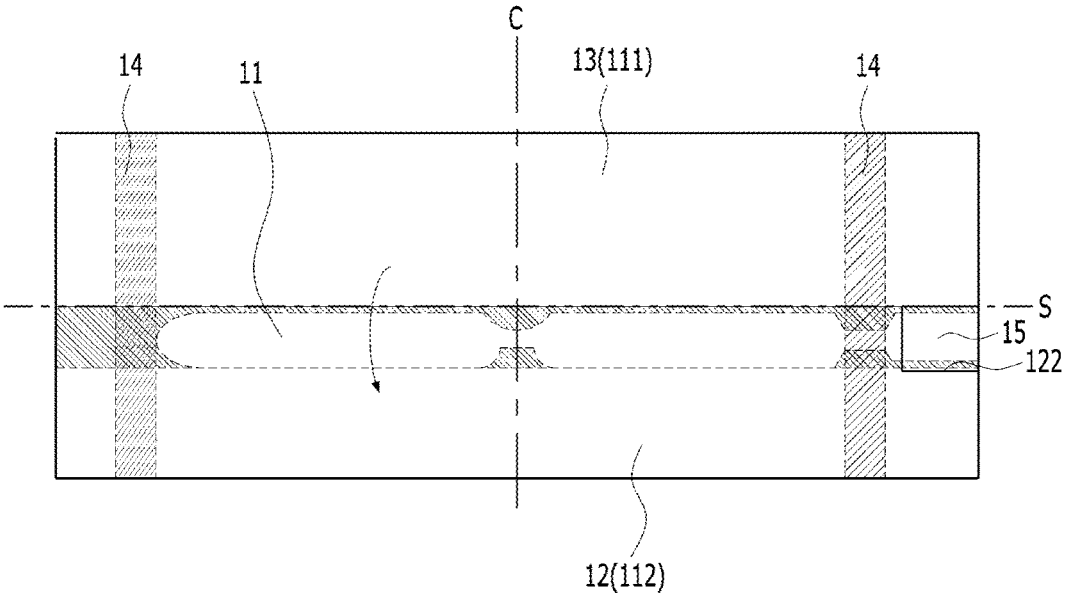

FIG. 4 illustrates a state before packing of the vegetable binding packing material 10 according to the embodiment of the present disclosure.

(a) of FIG. 4 illustrates a state before packing of the above-described vegetable binding packing material 10 according to the embodiment of FIG. 1 and illustrates a state in which the vegetable binding packing material 10 is spread. Here, "C" indicates a center line corresponding to the above-described nod 16, and the vegetable binding packing material 10 is folded with respect to the center line C in a state in which a certain amount of vegetables are placed thereon. (b) of FIG. 4 illustrates a state in which the first skirt part 12 composed of the outer film 112 and extending from the one side of the air column 11 is folded with respect to a folding line S to cover the outer surface of the air column 11.

The air column 11 is formed by a pattern 115 in which the inner film 111 and the outer film 112 are bonded. The folding line S may be defined by one side end line of the pattern 115. Meanwhile, a right end and a left end of the vegetable binding packing material 10 meet and overlap each other in drawings in a state in which the vegetable binding packing material 10 surrounds a certain amount of vegetables. The bonding portions 14 displayed at the right and left ends are bonded to bind the certain amount of the vegetables.

Figure 5:
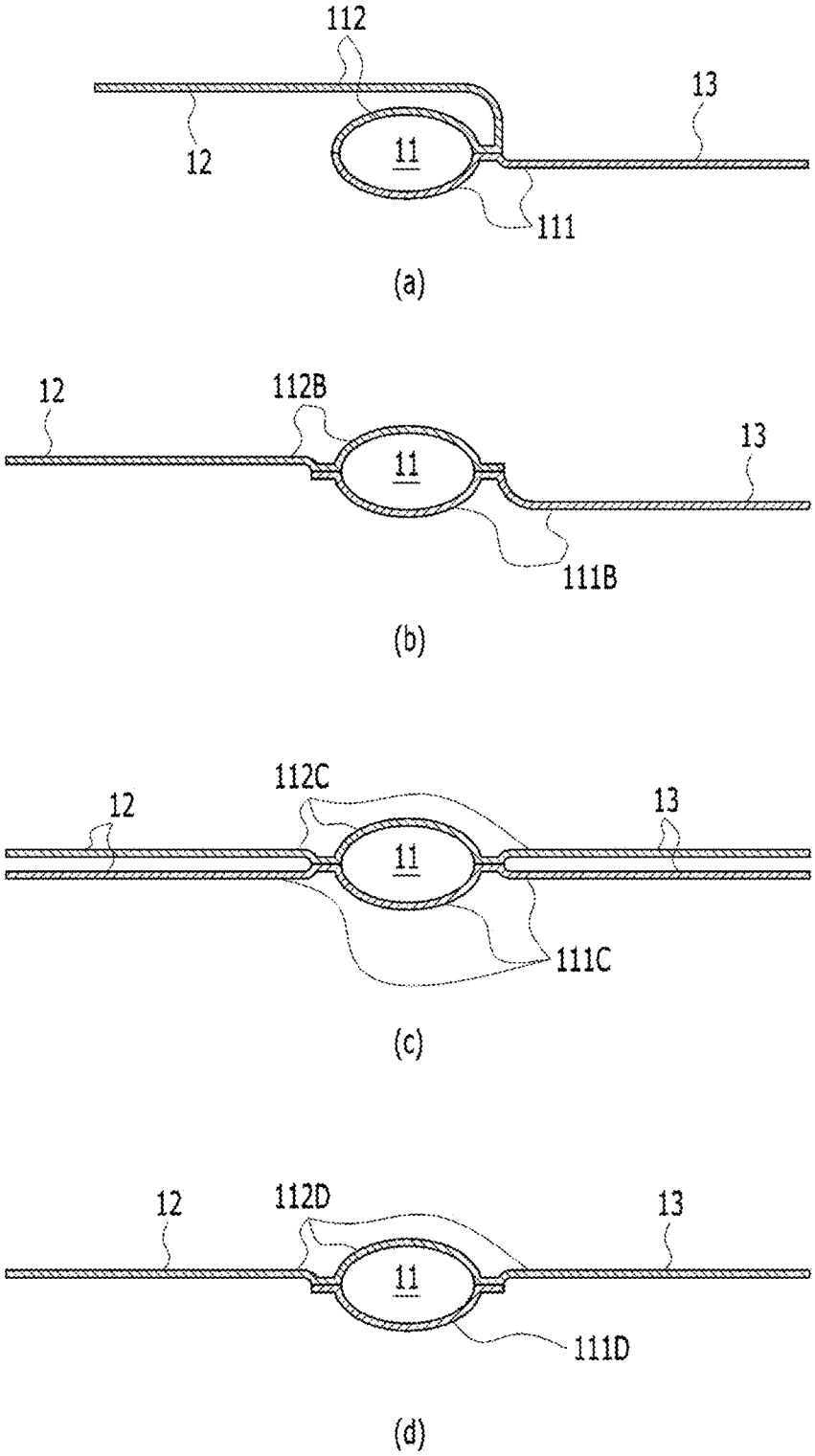
FIG. 5 illustrates examples of various connection forms of an air column and first and second skirt parts in a vegetable binding packing material according to the present disclosure.

FIG. 5 illustrates examples of various connection forms of the air column 11 and the first and second skirt parts 12 and 13 in the vegetable binding packing material 10 according to the present disclosure.

As illustrated in (a) of FIG. 5, the above-described embodiment has a pattern in which the inner film 111 and the outer film 112 are bonded to each other at one side of the air column 11. The second skirt part 13 extends from the inner film 111 among the pattern, and the first skirt part 12 extends from the outer film 112. However, the present disclosure is not limited thereto. As illustrated in (b) FIG. 5, patterns, in which an inner film 111B and an outer film 112B are bonded to each other, may be formed at both sides of the air column 11. The inner film 111B extends from one side of the air column 11 to form a second skirt part 13, and the outer film 112B may extend from the other side opposite to the one side to form a first skirt part 12.

In addition, as illustrated in (c) of FIG. 5, patterns, in which an inner film 111C and an outer film 112C are bonded, may be formed at both sides of the air column 11. The inner and outer films 111C and 112C may extend from the patterns in two directions to respectively form a double-layered first skirt part 12 and a double-layered second skirt part 13.

Meanwhile, (d) of FIG. 5 is the same as (c) of FIG. 5C in that patterns in which an inner film 111D and an outer film 112D are bonded are formed on both sides of the air column 11. (d) of FIG. 5 is different from FIG. 5C in that the inner and outer films 111D and 112D may extend from the patterns in two directions to respectively form a first skirt part 12 and a second skirt part 13. As described above, the first skirt part 12 and the second skirt part 13 may be formed in various forms. The first skirt part 12 and the second skirt part 13 may be modified in forms not illustrated here.

Figure 6:
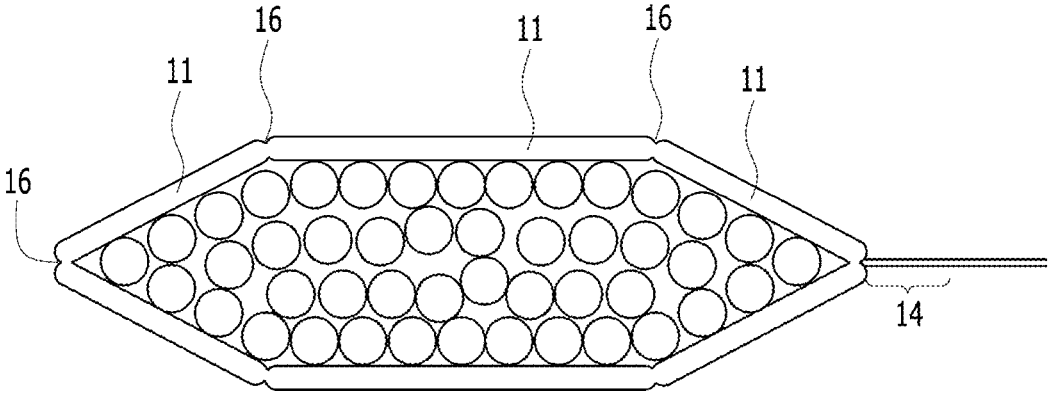
FIG. 6 illustrates a vegetable binding packing material including an air column having a plurality of nods, according to an embodiment of the present disclosure.

FIG. 6 illustrates a vegetable binding packing material including an air column 11 having a plurality of nods 16, according to an embodiment of the present disclosure.

As illustrated, the air column 11 may have the plurality of nods 16 formed to have a cross-sectional area narrower than that of other portions of the air column 11. Since the air column 11 is easily bent at the plurality of nods 16, a shape of a bundle of packed vegetables may be determined to how the plurality of nods 16 are arranged.

Figure 7:
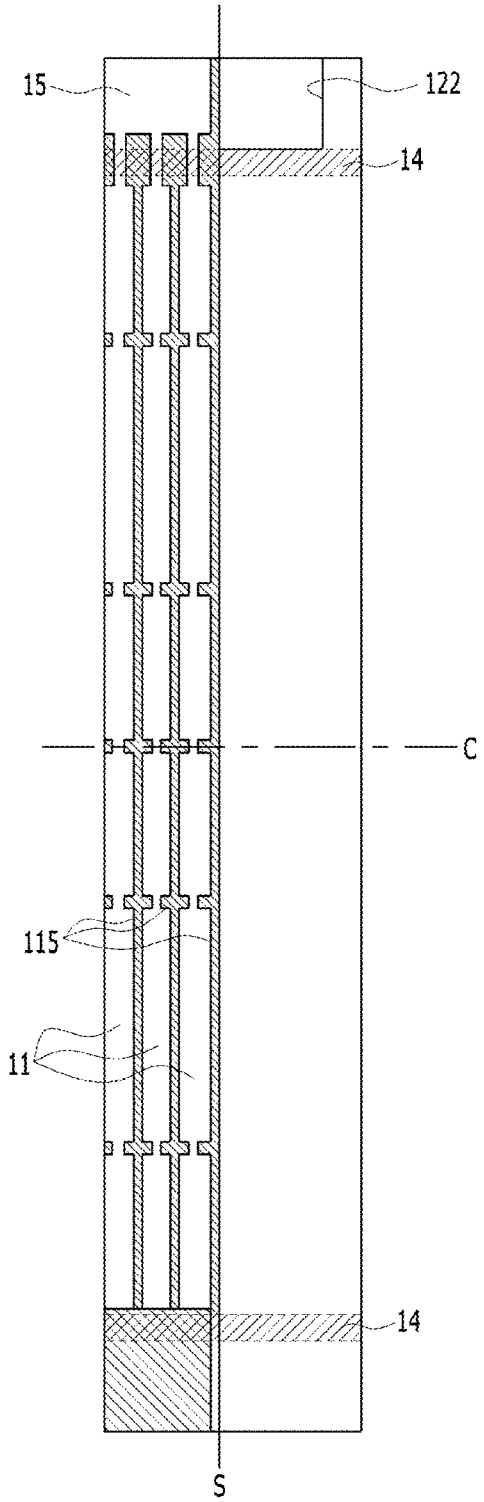
FIG. 7 illustrates a state before packing of a vegetable binding packing material including air columns disposed in a plurality of rows according to an embodiment of the present disclosure.

FIG. 7 illustrates a state before packing of the vegetable binding packing material including air columns 11 disposed in a plurality of rows according to an embodiment of the present disclosure.

As illustrated, the air columns 11 may be arranged in parallel to one another to constitute a plurality of rows. The air columns 11 in the plurality of rows may also be formed by a pattern in which an inner film and an outer film are bonded, and may be connected to one air inlet 15, so that air may be injected thereinto at the same time. After the completion of packing, the air columns 11 in the plurality of rows are separated from one another by the bonding portion 14 such that air does not flow therebetween. Thus, although any one air column 11 of the air columns 11 in the plurality of rows is damaged, the damaged air column 11 does not exert an influence on the remaining air columns 11.

Figure 8:
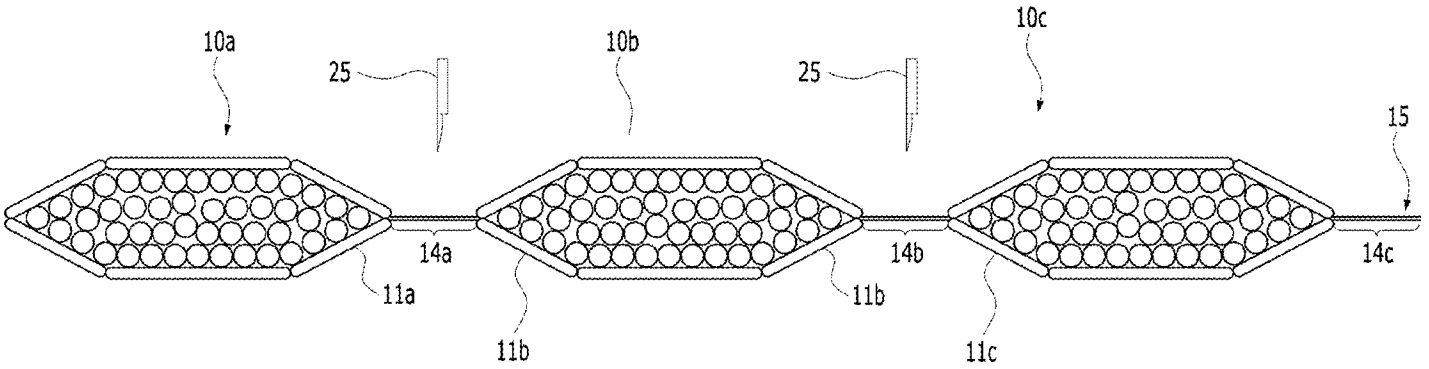
FIG. 8 illustrates a bundle-type vegetable binding packing material according to an embodiment of the present disclosure.

FIG. 8 illustrates a bundle-type vegetable binding packing material according to an embodiment of the present disclosure.

As illustrated, the bundle-type vegetable binding packing material includes a plurality of unit vegetable binding packing materials, for example, three unit vegetable binding packing materials 10*a*, 10*b*, and 10*c* in the present embodiment. Each of the unit vegetable binding packing materials 10*a*, 10*b*, and 10*c* may include at least one air column 11*a*, 11*b*, or 11*c* and at least one bonding portion 14*a*, 14*b*, or 14*c*. In this case, the air columns of the plurality of unit vegetable binding packing materials are formed such that air flows therebetween before packing. Accordingly, air is injected into the air columns through a common air inlet formed at any one of the air columns, and the air columns may be separately sealed by the bonding portions 14*a*, 14*b*, and 14*c*.

On the other hand, in the bundle-type vegetable binding packing material, packing may be completed in a state in which the plurality of unit vegetable binding packing materials are connected to each other, or the plurality of unit vegetable binding packing materials may be separated from one another by a cutting blade 25. In addition, when the cutting blade 25 is a dashed-line cutting blade, portions of the bundle-type vegetable binding packing material between vegetable bundles bound by the bundle-type vegetable binding packing material may be imperfectly cut in the form of a dotted-line, and the bundle-type vegetable binding packing material may be provided so as to be easily cut with hands in case of necessity.

Figure 9:
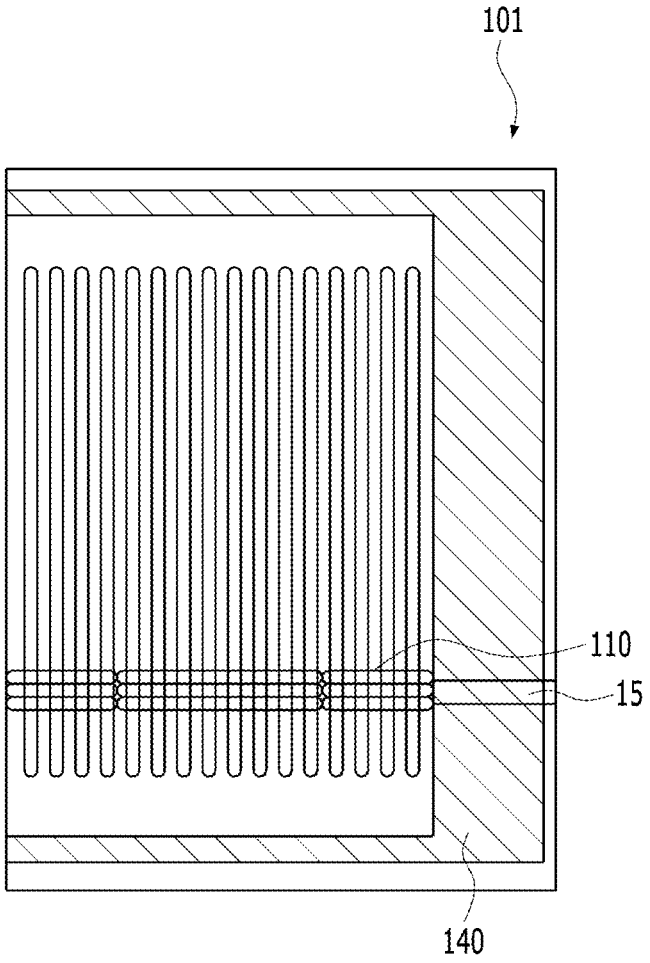
FIG. 9 illustrates a vegetable binding packing material for three-side packing, according to an embodiment of the present disclosure.

FIG. 9 illustrates a vegetable binding packing material 101 for three-side packing, according to an embodiment of the present disclosure.

In an embodiment of the present disclosure, the vegetable binding packing material 101 for three-side packing including air columns 110 may have a size such that a first skirt part extending toward leaves of vegetables and a second skirt part extending toward stems or roots of the vegetables cover the whole of the vegetables. A bonding portion 140 configured to bond opened portions around the vegetables as well as the air inlet 15 may be formed in a state in which air is injected through the air inlet 15 to form an air column 110 formed in a row or air columns 110 formed in a plurality of rows, so that three-side packing may be performed on the vegetables.

Meanwhile, the vegetable binding packing material 101 for three-side packing may further include vegetables as well as a fresh auxiliary material such as an ice pack, a gas pack, or a sponge (absorbing water or chemicals) therein, which assists to maintain the freshness of the vegetables. In addition, packing may be completed in a vacuum atmosphere or in a gas atmosphere for assisting to maintain the freshness of the vegetables, so that the vegetable binding packing material 101 for three-side packing may be maintained in a vacuum state or a state of being filled with a specific gas.

Figure 10:
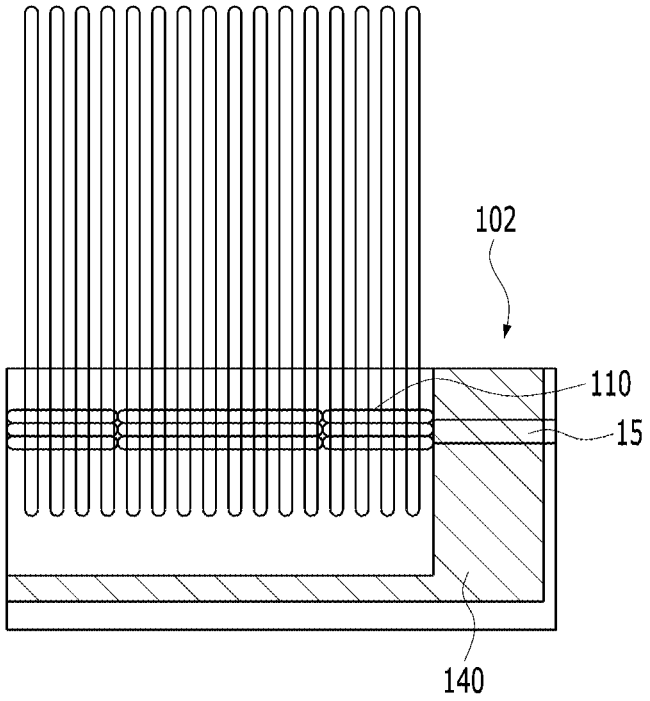
FIG. 10 illustrates a vegetable binding packing material for partial three-side packing, according to an embodiment of the present disclosure.

FIG. 10 illustrates a vegetable binding packing material 102 for partial three-side packing, according to an embodiment of the present disclosure.

In the vegetable binding packing material 102 for partial three-side packing according to the present embodiment of the present disclosure, three-side packing may be formed to pack a portion of each of vegetables by extending a skirt part only from one side of the air columns 110 and bonding a peripheral portion of the skirt part.

The embodiments of the vegetable binding packing materials described above may be used to mainly bind and pack vegetables such as leeks, spinach, green onions, and Chinese cabbages. However, the present disclosure is not limited thereto, and the embodiments of the vegetable binding packing materials may be used to bind and pack flowering plants such as a bunch of flowers, fruit vegetables, fruits, marine products, or the like.

On the other hand, a biodegradable film, a photodegradable film, or the like may be used as a film material constituting the inner film and the outer film described above, so that the vegetable binding packing materials may be provided as an eco-friendly packing material.

Information on a packed product or the like may be printed on the skirt part. In addition, a hole, into which a hand is inserted, may be formed in an edge of the vegetable binding packing material including the bonding portion or the like such that the edge is used as a handle.

Figure 11:
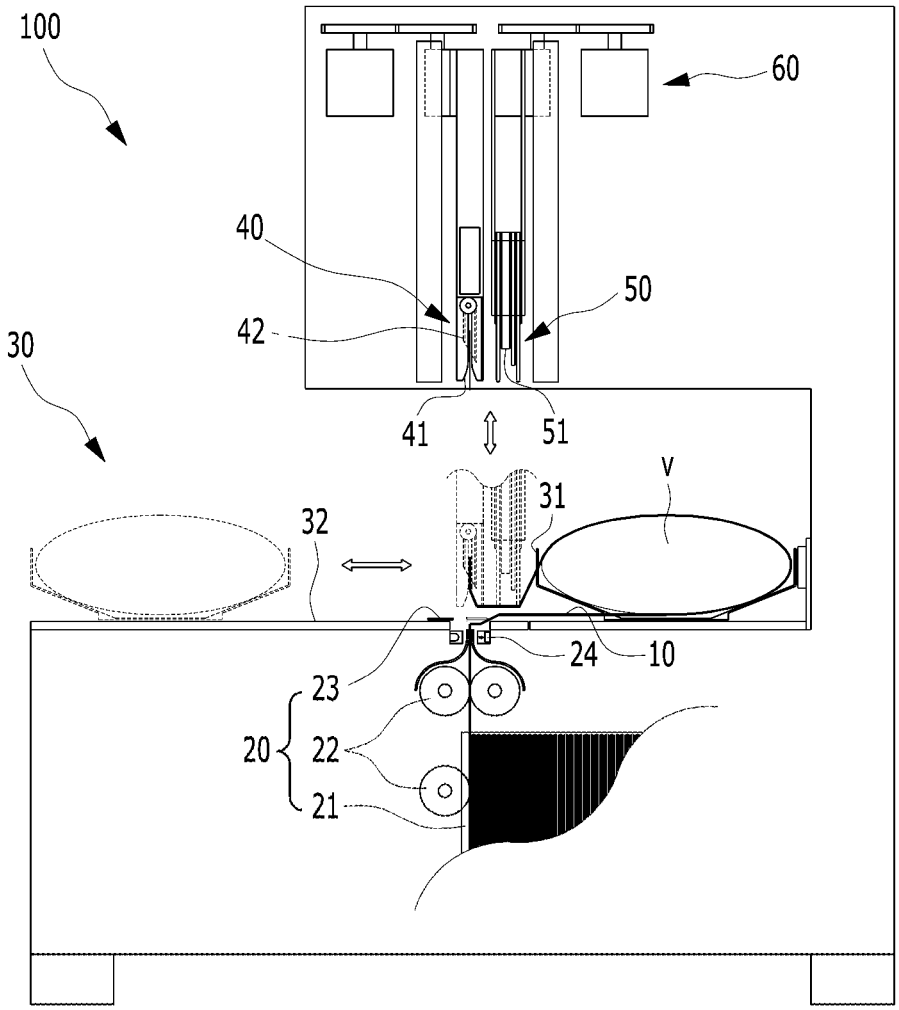
FIG. 11 illustrates an overall configuration of a vegetable binding packing device according to an embodiment of the present disclosure.

FIG. 11 illustrates an overall configuration of a vegetable binding packing device 100 according to an embodiment of the present disclosure.

According to the present embodiment, the vegetable binding packing device 100 using an air column packing material 10 includes a packing material supply unit 20 configured to feed the air column packing material 10, a clamp injection module 40 configured to pull a front portion of the air column packing material 10 to assist a transfer of the air column packing material 10 and to inject air into an air column pattern, a vegetable supply unit 30 configured to supply vegetables V to be packed, in a direction crossing the air column packing material 10, and a sealing module 50 configured to bond front and rear portions of the air column packing material 10 surrounding the vegetables V and extending toward one side to overlap each other and to seal the air column pattern across the air column pattern in a state in which air is injected into the air column pattern.

In an example, the packing material supply unit 20 may include a packing material cartridge 21 in which the air column packing materials 10 are supplied in a state of being separated from one another or are supplied in a state of being accumulated in the form of a plurality of discontinuous sheets, and a supply roller 22 configured to supply a sheet of the air column packing materials 10 to a packing stage from the packing material cartridge 21. In addition, the packing material supply unit 20 may further include a sensor 24 at a portion at which the packing material supply unit 20 meets the packing stage and a packing material guide 23 configured to guide a transfer direction of the air column packing material 10 supplied to the packing stage, the sensor 24 being configured to sense whether the front portion of the air column packing material 10 reaches the packaging stage, or a length, or the like of a portion of the air column packing material 10 supplied to the packing stage. The packing material guide 23 may also function to temporarily support the rear portion of the supplied air column packaging material 10.

The vegetable supply unit 30 may include a vegetable hopper 31 configured to carry the vegetables V on the packaging stage and a hopper rail 32 configured to guide the vegetable hopper 31 to shuttle between a loading position at which the vegetables V are loaded on the vegetable hopper 31, and a packing position at which the vegetables V are packed by using the air column packing material 10.

The clamp injection module 40 and the sealing module 50 may be disposed above the packing stage and may be configured to perform functions thereof while vertically moving as indicated by arrows and dotted lines in FIG. 11. To this end, an elevation driving unit 60 may be provided. The elevation driving unit 60 may be configured to concurrently or individually elevate the clamp injection module 40 and the sealing module 50.

The clamp injection module 40 may be configured to clamp the front portion of the air column packing material 10 and inject air into the air column pattern, the air column packing material 10 being composed of two films and having an air column pattern formed in which the two films are bonded or connected to each other in a lengthwise direction thereof. The clamp injection module 40 has a clamping part configured to clamp the front portion of the air column packing material 10 and an injection part configured to inject air into the air column pattern. Detailed structures of the clamping part and the injection part will be described in detail with reference to related drawings.

Figure 12:
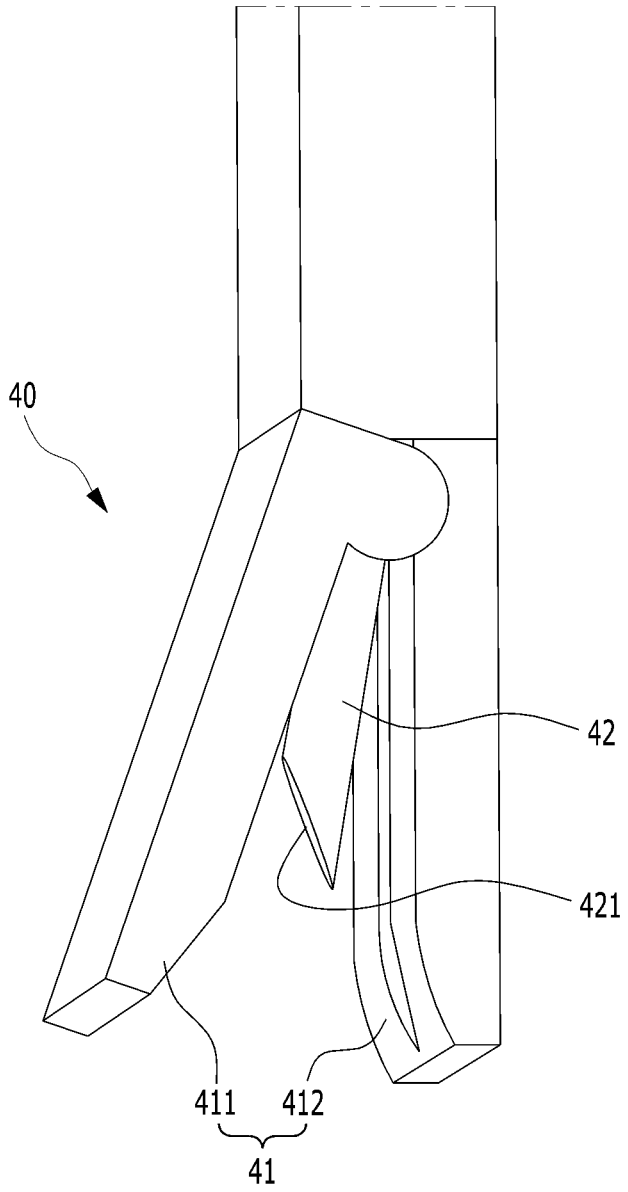
FIG. 12 illustrates a configuration of a clamp injection module of the embodiment of FIG. 11 in detail.

FIG. 12 illustrates a configuration of the clamp injection module 40 of the embodiment of FIG. 11 in detail.

The clamp injection module 40 may include a clamp jaw configured to clamp both surfaces of the air column packing material 10 as an example of the clamping part. The clamp jaw 41 may be configured to be pivotably rotated on a hinge as illustrated in FIG. 12 and to clamp the air column packing material 10 by pressurizing both surfaces of the air column packing material 10. The clamp jaw 41 may also be configured to clamp the air column packing material 10 by adsorbing both surfaces or one surface of the air column packing material 10. Meanwhile, the clamp injection module 40 may include an injection needle 42 as an example of the injection part configured to inject air into the air column pattern, the injection needle 42 being inserted into the air column pattern by widening a space between the two films. An end 421 of the injection needle 42 may be inclined in one direction, such that the injection needle 42 is easily inserted between the two films while a pair of clamp jaws 411 and 412 clamps the front portion of the air column packing material 10.

Figure 13:
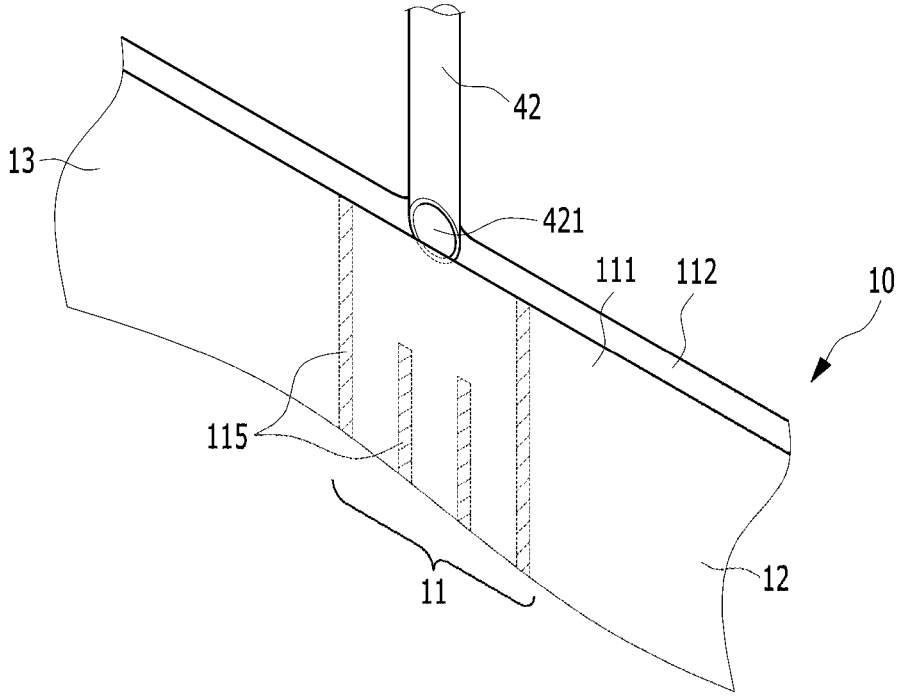
FIG. 13 illustrates shows a state in which an injection needle is inserted through an air inlet of a discontinuous sheet-shaped air column packing material in the vegetable binding packing device according to the embodiment of FIG. 11.

In addition, a grove corresponding to an outer shape of the injection needle 42 is formed on at least one side of the pair of clamp jaws 411 and 412, such that one side film of the air column packing material 10 is bent to form an inlet of the air column pattern. Thus, the injection needle 42 may be rightly injected. FIG. 13 illustrates a state in which the injection needle 42 is inserted through an air inlet of a discontinuous sheet-shaped air column packing material 10 in the vegetable binding packing device according to the embodiment of FIG. 11.

The discontinuous sheet-shaped air column packing material 10 includes double-layered films 111 and 112 and an air column 11 formed by a partial bonding pattern 15 of the double-layered films 111 and 112. The discontinuous sheet-shaped air column packing material 10 may further include skirt parts 12 and 13 extending from two sides of the air column 11. In addition to a shape illustrated here, the skirt parts 12 and 13 may have a shape extending only from one side of the air column 11 and a shape composed only of a single-layered film rather than a double-layered film.

A front portion of the discontinuous sheet-shaped air column packing material 10 may be formed such that one film 111 of the double-layered films 111 and 112 is slightly shorter than the other film 112. As a result, when the inclined end 421 of the injection needle 42 comes in close contact with the relatively long film 112, an end of the relatively short film 111 spontaneously goes away from the film 112 along an inclined surface, and thus, the injection needle 42 is inserted between the films 111 and 112. Meanwhile, air columns disposed in a plurality of rows may be formed in the air column 11 of the discontinuous sheet-shaped air column packing material 10 by the above-described bonding pattern 115.

Figure 14:
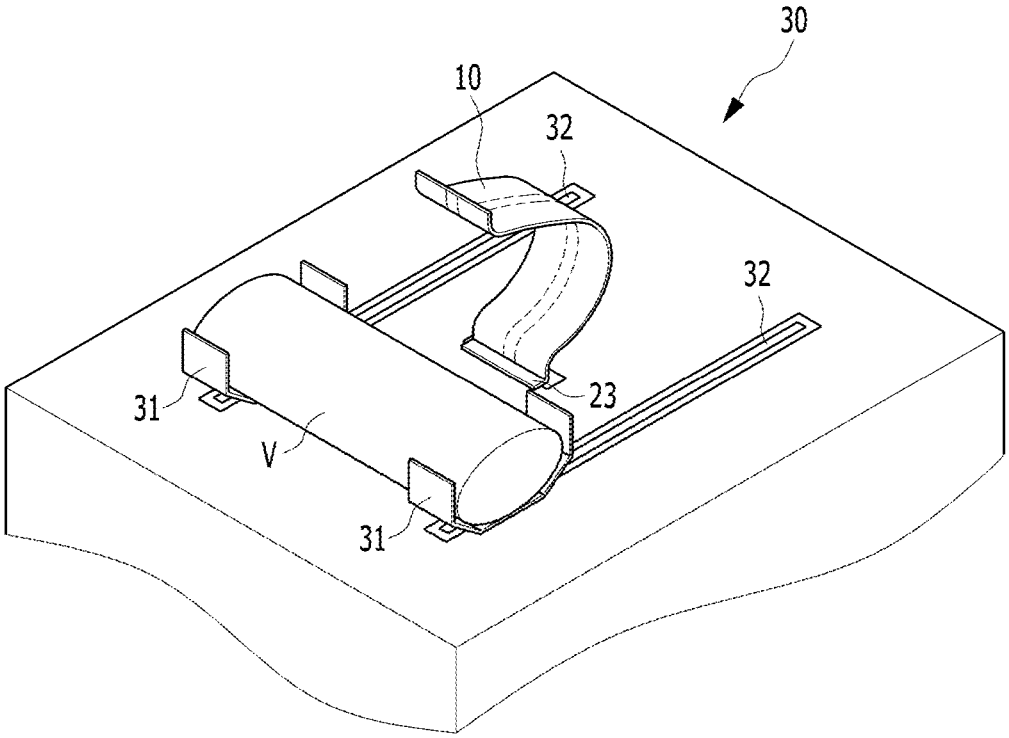
FIG. 14 illustrates an example of a configuration for supplying a packing material and vegetables to be packaged, in the embodiment of FIG. 11.

FIG. 14 illustrates an example of a configuration for supplying the air column packing material 10 and the vegetables to be packaged, in the embodiment of FIG. 11.

As described above, the vegetable supply unit 30 includes the vegetable hopper 31 disposed on the packing stage and the hopper rail 32 configured to move the vegetable hopper 31. A left part of the hopper rail 32 is a loading position at which the vegetables V are loaded on the vegetable hopper 31 and the right part of the hopper rail 32 is a packing position at which a bundle of the vegetables V loaded on the vegetable hopper 31 is packed, with respect to a direction illustrated in FIG. 14. The vegetable hopper 31 may have two parts so as to support both of a root and a leaf of each of the vegetables V by avoiding a portion on which where the air column packing material 10 is wound. The hopper rail 32 may be disposed in accordance with the vegetable hopper 31.

The front portion of the air column packing material 10 is not illustrated in FIG. 14, and the air column packing material 10 is transferred in a state in which the front portion thereof is clamped by the above-described clamp injection module 40 and is bent by the packing material guide 23 in a direction in which the vegetables V are surrounded. When the vegetable hopper 31 moves to the packing position described above, the air column packing material 10 surrounds upper, lower, and right surfaces of the vegetables V. Then, when the clamp injection module 40 and the sealing module 50 are moved downwardly to the packing stage, front and rear portions of the air column packing material 10 are all supported in a state in which the air column packing material 10 surrounds a left surface of the vegetables V as well as the upper, lower, and right surfaces.

Figure 15:
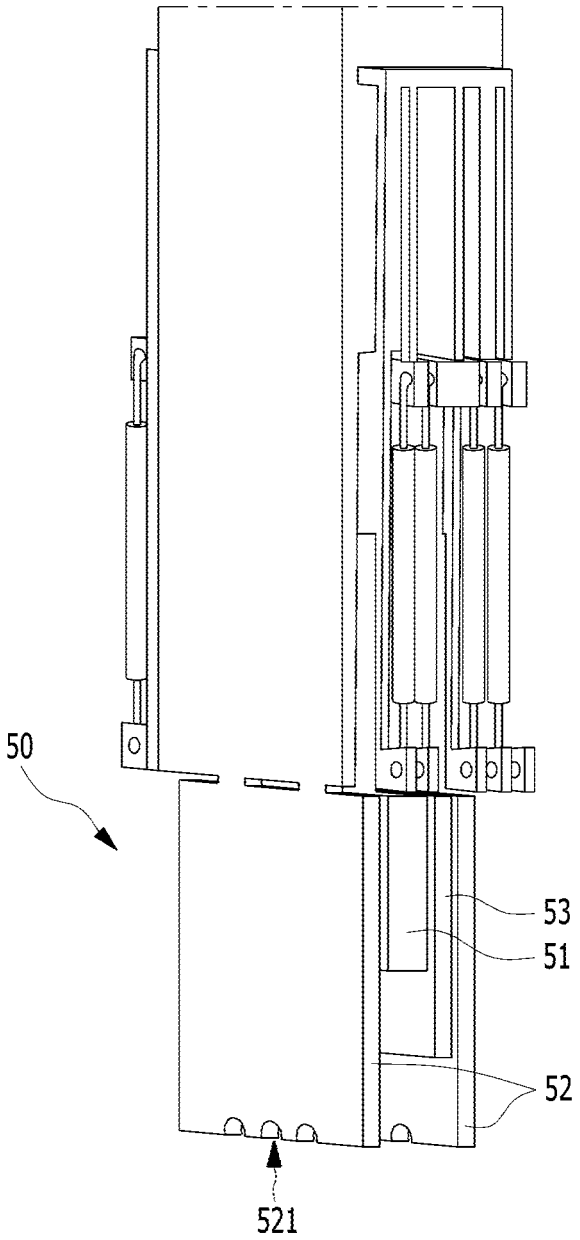
FIG. 15 illustrates a configuration of a sealing module in the embodiment of FIG. 11 in detail.
Figure 16:
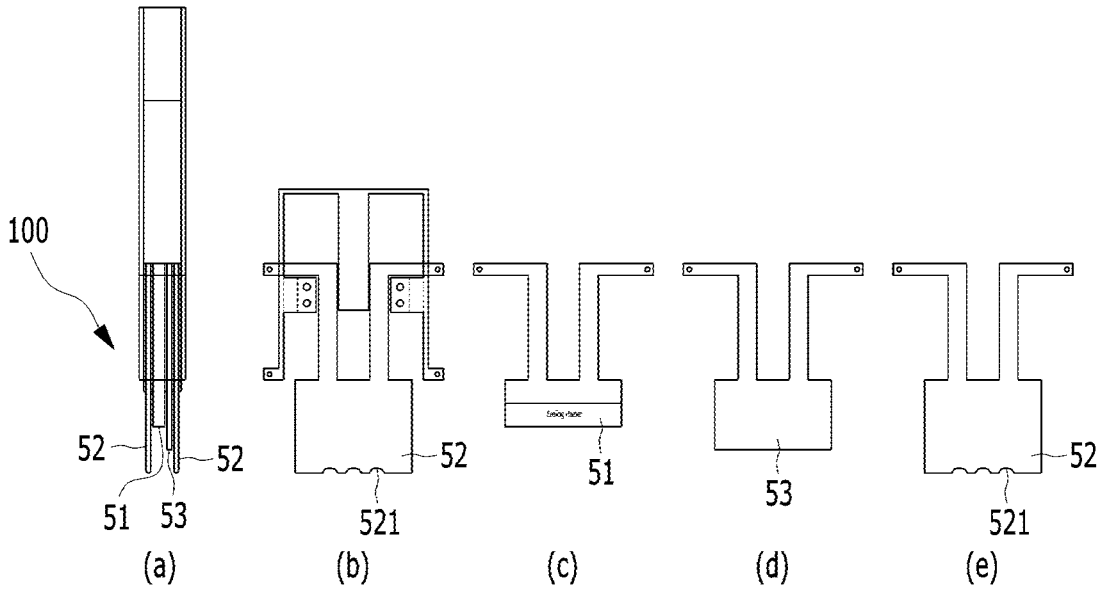
FIG. 16 illustrates specific examples of a plurality of parts constituting the sealing module.

FIG. 15 illustrates a configuration of the sealing module 50 in the embodiment of FIG. 11 in detail. FIG. 16 illustrates specific examples of a plurality of parts constituting the sealing module 50.

The sealing module 50 may be configured such that a plurality of parts are downwardly moved individually or in pairs from a frame elevated between certain positions to pressurize a portion of the air column packing material 10. Describing a more specific example, the sealing module 50 may include a sealing head 51 configured to pressurize portions of the air column packing material 10, i.e., bonding portions to hermetically bond the bonding portions, a pair of sealing guides 52 disposed at front and rear sides of the sealing head 51 to pressurize and support both sides of the bonding portions, and an air blocking part 53 disposed between the sealing head 51 and the sealing guide 52 at the rear side among the pair of sealing guides 52 to pressurize and block an air column before a bonding operation of the sealing head 51.

The sealing head 51 forms a bonding portion by bonding the double-layered films 111 and 112 constituting the air column packing material 10 and forms a bonding portion by bonding portions of the air column packing material 10, which surround vegetables and overlap each other. The sealing head 51 may perform bonding through various methods according to properties of the air column packing material 10. In an example, the sealing head 51 may heat-weld a thermoplastic film. In addition, the sealing head 51 may perform bonding through a method such as ultrasonic welding or squeezing. A silicon pad having excellent thermal resistance may be provided on a portion of the packing stage corresponding to the sealing head 51.

The pair of sealing guides 52 pressurizes and supports the air column packing material 10 toward the packing stage during bonding and has a groove 521 corresponding to the air column of each row such that air is injected into the air column 11 to form the air columns in the supported state. On the other hand, the air blocking part 53 may be moved downwardly before a bonding operation to temporarily block the air columns such that portions of the air column packing material 10 corresponding to the sealing head 51 come into close contact with each other without air. Meanwhile, even after the sealing head 51 finishes the bonding operation and is moved upwardly to return an original position thereof, the air blocking part 53 may block air from flowing into a bonding portion for a predetermined time, thereby securing a time for the bonding portion to be solidified.

Figure 17:
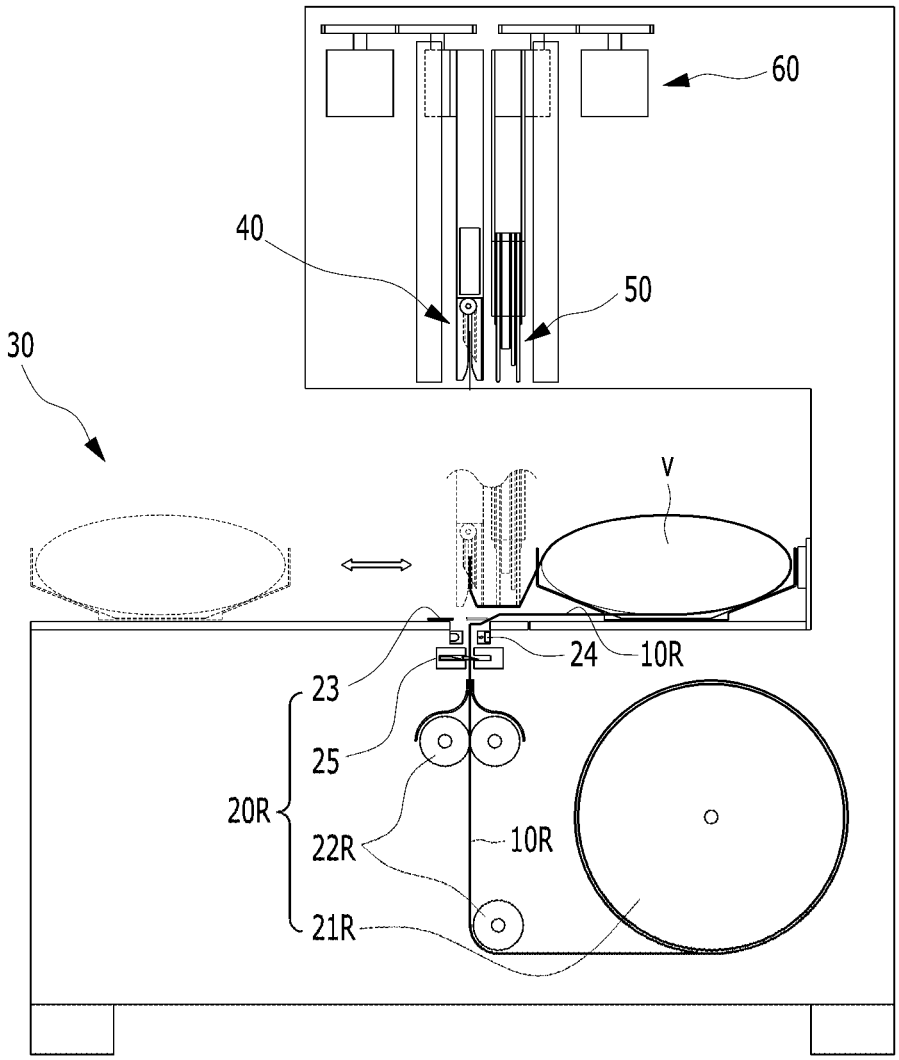
FIG. 17 illustrates an overall configuration of a vegetable binding packing device according to an embodiment of the present disclosure.

FIG. 17 illustrates an overall configuration of a vegetable binding packing device according to an embodiment of the present disclosure.

Since most elements of the present embodiment are the same as or similar to those of the embodiment of FIG. 11, the following description will focus on differences between the present embodiment and the embodiment of FIG. 11.

According to the present embodiment, the vegetable binding packing device includes a continuous-roll-shaped packing material supply unit 20R configured to supply a vegetable binding packing material 10R having air columns from a packing material cartridge 21R having a roll shape. In this case, the vegetable binding packing material 10R may be transferred to a packing stage by using a plurality of supply rollers 22R. Meanwhile, in the present embodiment, the continuous-roll-shaped packing material supply unit 20R may further include a packing material cutter 25 to cut the vegetable binding packing material 10R into a unit length required for packaging a bundle of vegetables V.

Figure 18:
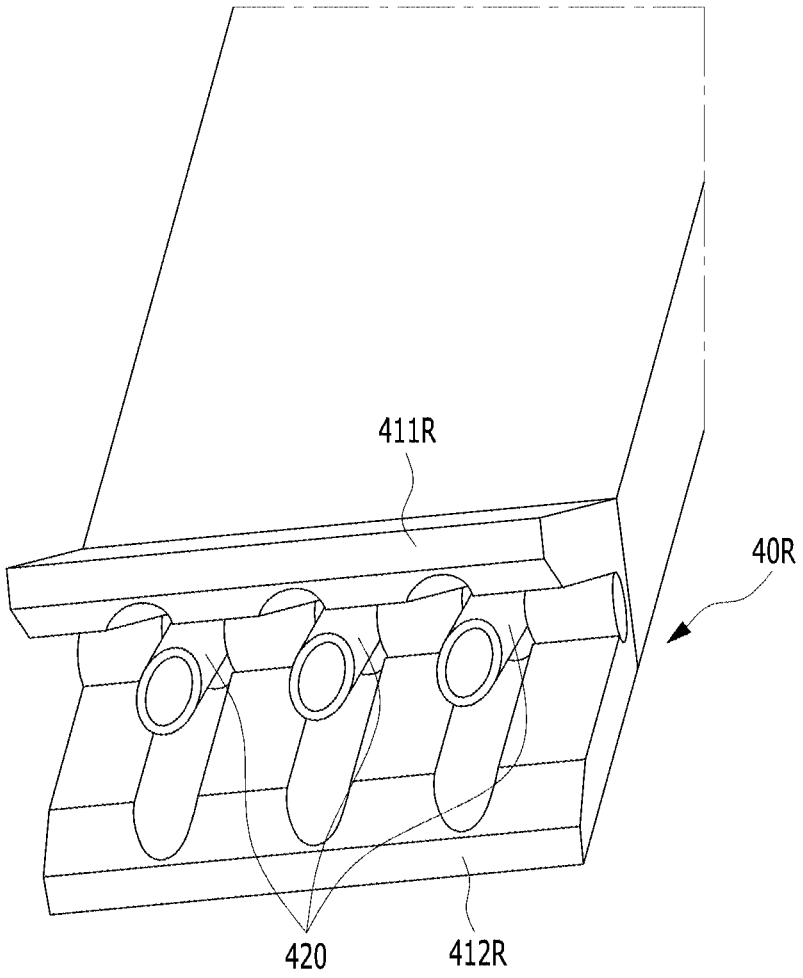
FIG. 18 illustrates a configuration of a clamp injection module in the embodiment of FIG. 17 in detail.

FIG. 18 illustrates a configuration of a clamp injection module 40R in the embodiment of FIG. 17 in detail.

As illustrated in FIG. 18, according to the present embodiment, a plurality of injection needles 420 may be provided between a pair of clamp jaws 411R and 412R in the clamp injection module 40R. The number of the injection needles 420 may be equal to the number of the air columns formed in parallel to one another in the vegetable binding packing material 10R having a continuous roll shape.

Figure 19:
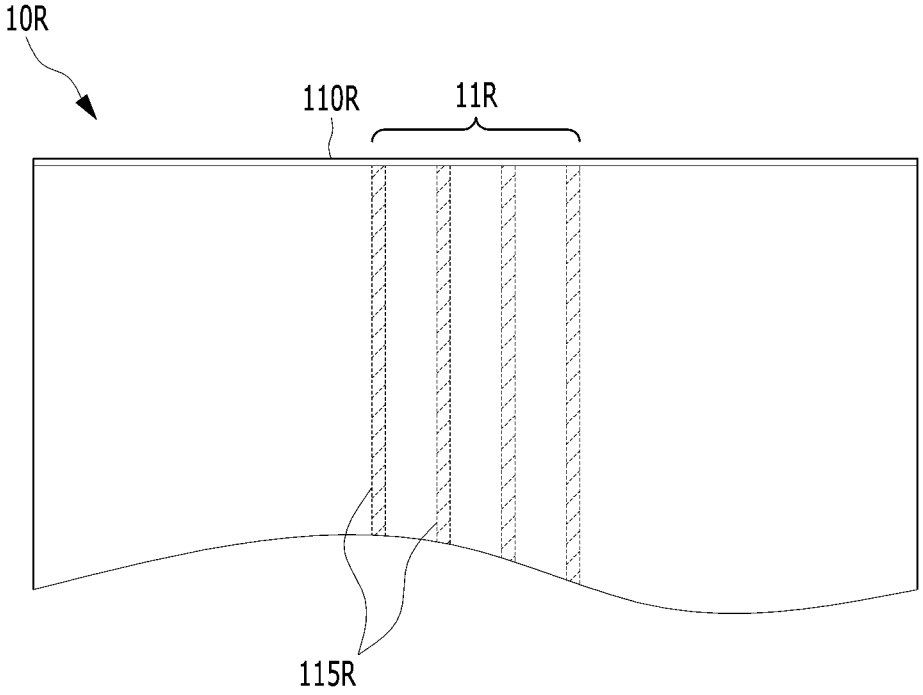
FIG. 19 illustrates a vegetable binding packing material having a continuous roll shape, used in the vegetable binding packing device according to the embodiment of FIG. 17.

FIG. 19 illustrates the vegetable binding packing material 10R having the continuous roll shape, used in the vegetable binding packing device according to the embodiment of FIG. 17.

Referring to FIGS. 18 and 19, as illustrated in FIG. 19, when an air column part 11R for forming the air columns in a plurality of rows is formed in the vegetable binding packing material 10R having the continuous roll shape by a continuous bonding patterns 115R formed in a lengthwise direction of the air column 11R, the plurality of injection needles 420 may be respectively inserted into a plurality of air column patterns, and thus, air may be injected into the plurality of air column patterns.

Figure 20:
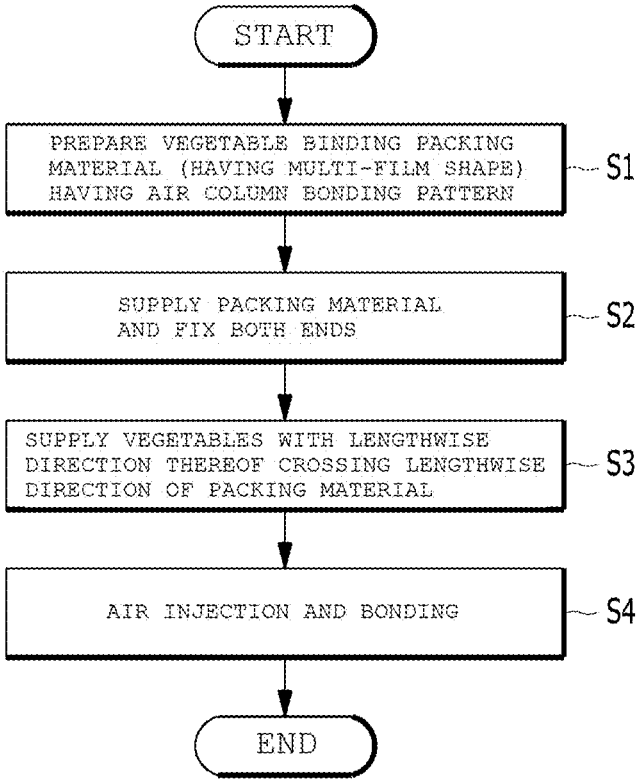
FIG. 20 is a schematic flowchart of a vegetable binding packing method according to an embodiment of the present disclosure.

FIG. 20 is a schematic flowchart of a vegetable binding packing method according to an embodiment of the present disclosure.

Here, descriptions will be provided with reference to FIG. 11 related to the vegetable binding packing device performing the vegetable binding packing method according to the present embodiment. Those skilled in the art will understand the vegetable binding packing method using the vegetable binding packing device of FIG. 7 through a packing method described with reference to the vegetable binding packing device of FIG. 11.

First, a vegetable binding packing material 10 having a multi-film type air column pattern formed by using an air column bonding pattern, that is, a pattern in which at least two double-layered films are connected or bonded to each other (S1). Next, the vegetable binding packing material 10 is transferred and supplied to the vegetable supply unit 30 on the packing stage (S2). In this case, the above-described clamp injection module 40 may be moved downwardly to the packing material supply unit 20 and may be moved upwardly while clamping a front portion of the transferred vegetable binding packing material 10. The clamping operation and an insertion operation of the injections needles 42 may be performed almost at the same time. As described above, the vegetable binding packing material 10 is additionally transferred a certain distance in a state in which the clamp injection module 40 clamps the front portion of the vegetable binding packing material 10, and a rear portion of the vegetable binding packing material 10 is supported by the packing material guide 23, the supply roller 22, or the like. In this state, the vegetables V are supplied by using the vegetable hopper 31 of the vegetable supply unit 30 (S3). The vegetables V are supplied so as to cross a lengthwise direction of the vegetable binding packing material 10. After that, an air injecting and bonding operation are performed (S4).

In the vegetable binding packing method according to the above-described embodiment, operation S1 of preparing the vegetable binding packing material 10 will be described with reference to FIG. 4 again. (a) of FIG. 4 illustrates a state before packing of the above-described vegetable binding packing material 10 and illustrates a state in which the vegetable binding packing material 10 is spread. Here, a right side of the drawing, in which the air inlet 15 is formed, corresponds to the front portion, and on the contrary, a left side of the drawing corresponds to a rear portion of the vegetable binding packing material 10. Here, in the vegetable binding packing material 10, the air column 11 are formed by the pattern 115 in which the inner film 111 and the outer film 112 are bonded to each other at lower end of (a) of FIG. 4. The inner film 111 and the outer film 112 extend from the air column 11 to form skirt parts. Then, as illustrated in (b) of FIG. 4, the first film 112 composed of the outer film 112 and extending from one side of the air column 11 is folded with respect to the center line S to cover an outer surface of the air column 11.

Describing a packed state of the vegetables V packed through the vegetable binding packing method with reference to FIG. 1 again, a bundle of the packed vegetables V includes the skirt parts 12 and 13 extending from the air column 11 in the lengthwise direction of the vegetables V. The skirt parts 12 and 13 may have the first skirt part 12 extending from the air column 11 to a first end, i.e., the leaves VL of the vegetables V in the lengthwise direction of the vegetables V and the second skirt part 13 from the air column 11 to a second end, i.e., the stems or roots VR of the vegetables V in the lengthwise direction of the vegetables V.

Meanwhile, as described above, when the first and second skirt parts 12 and 13 are formed and the vegetable binding packing material 10 including the air column 11 is bonded, it is desirable that bonding portions are formed at both ends of the air column 11 as well as at a portion at which the first and second skirt parts 12 and 13 overlap each other, i.e., along a peripheral portion of the first and second skirt parts 12 and 13.

Figure 21:
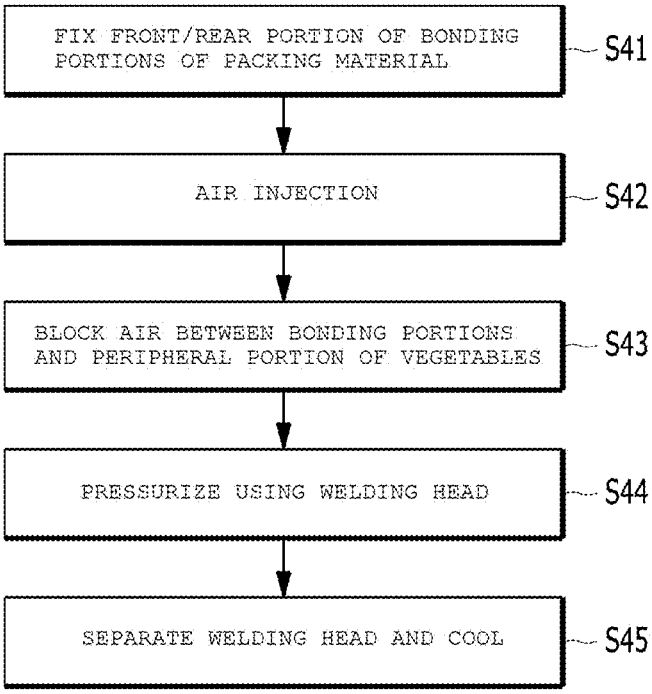
FIG. 21 illustrates a sequence of an air injecting and bonding operation in the vegetable binding packing method according to the embodiment of FIG. 20 in more detail.
Figure 22:
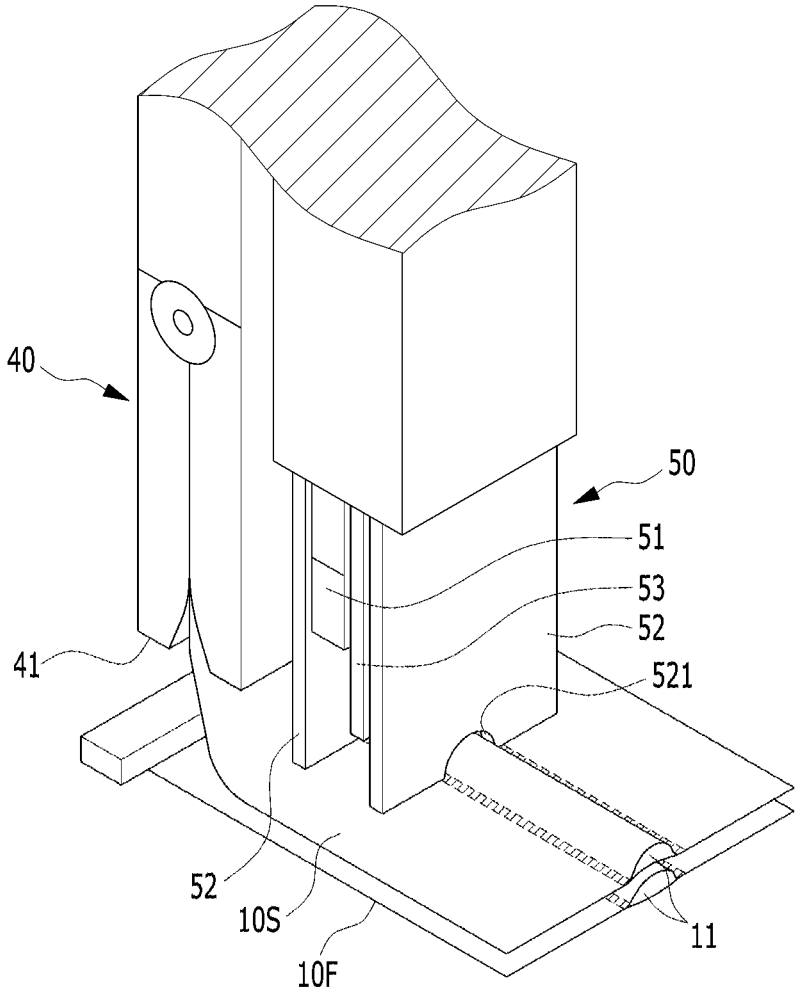
FIG. 22 illustrates an operation state of a clamp injection module and a sealing module performing the air injecting and bonding operation illustrated in FIG. 21.

FIG. 21 illustrates a sequence of an air injecting and bonding operation in the vegetable binding packing method according to the embodiment of FIG. 20 in more detail. FIG. 22 illustrates an operation state of the clamp injection module 40 and the sealing module 50 performing the air injecting and bonding operation illustrated in FIG. 21. (a) to (e) of FIG. 23 illustrate an operation state of the sealing module 50 illustrated in FIG. 22 according to a time sequence.

Figure 23:
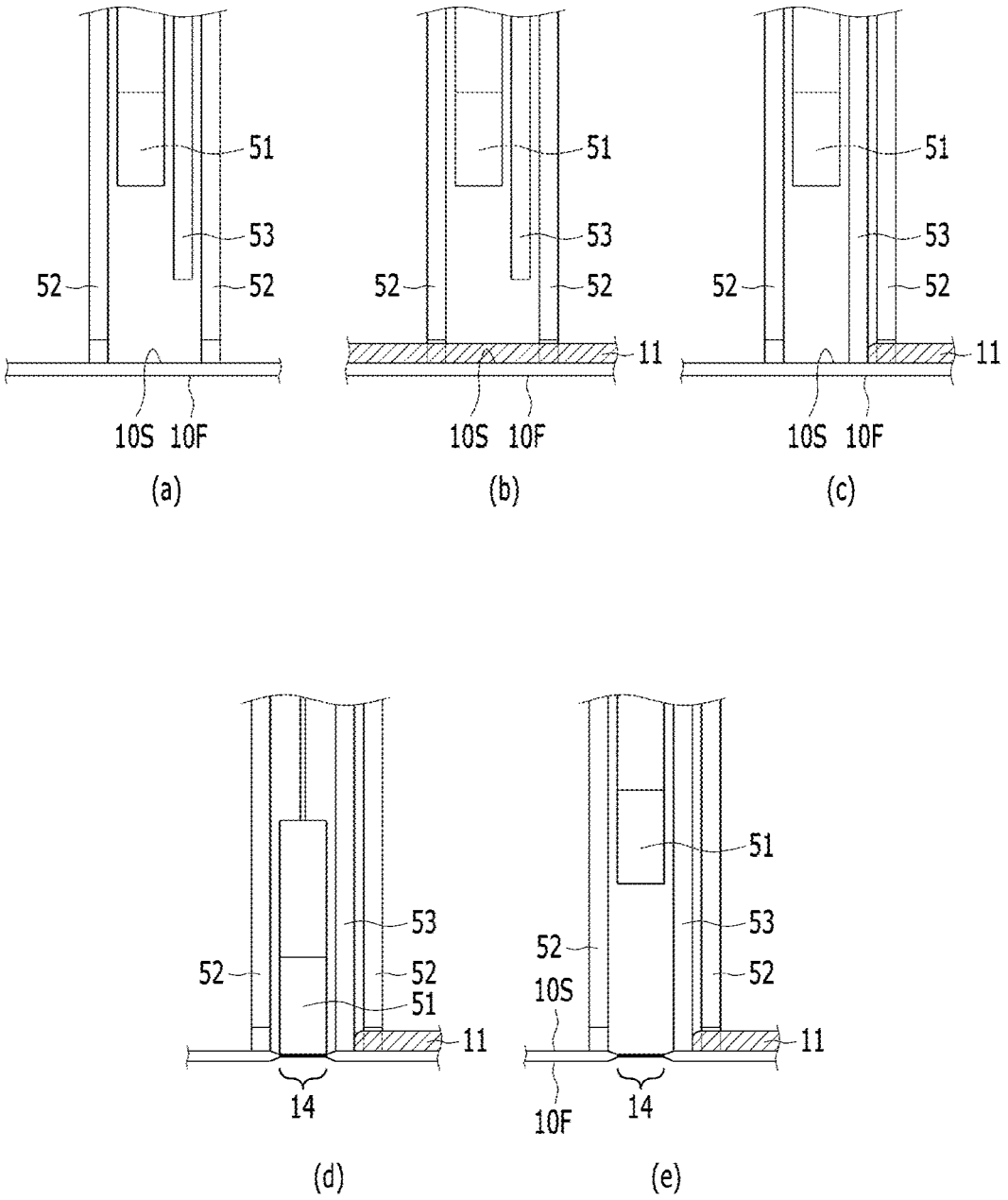
FIG. 23 illustrates change in an operation state of the sealing module illustrated in FIG. 22 according to a time sequence.

As illustrated in (a) of FIG. 23, the sealing module is moved downwardly and the pair of sealing guide 52 disposed both sides of the sealing head 51 pressurizes and fixes both sides of the bonding portions of the vegetable binding packing material 10 to start the air injecting and bonding operation (S41). In this case, the vegetable binding packing material 10 is supported in a state in which a front portion 10S and a rear portion 10F thereof overlap each other. In this state, as illustrated in (b) of FIG. 23, air is injected into the above-described air column pattern (S42). When the air is injected, the air columns 11 are formed at both of the front portion 10S and the rear portion 10F as well as in a region surrounding the vegetables V. Only the air column 11 of the front portion 10S is illustrated in FIG. 23 for convenience sake.

Then, as illustrated in (c) FIG. 23C, the air blocking part 53 is moved downwardly to pressurize the air column 11 and block air (S43). In this case, air remaining in the front portion 10S of the vegetable binding packing material 10 is discharged to the outside through the injection needles or surrounding portions of the injection needles, and the sealing head 51 heats and welds the bonding portions 14 by pressurizing and contacting the bonding portions 14, i.e., portions of the vegetable binding packing material 10, which are bonded to each other. In addition to the thermal welding, pressuring may be performed through ultrasonic welding or squeezing using an adhesive film as described above. The sealing head 51 is moved upwardly and is separated from the heat-welded portions, i.e., the bonding portions 14 such that the bonding portions 14 are quickly cooled by ambient air. After such a process, when the sealing module 50 is moved upwardly and is separated from the packing stage, a vegetable packing operation using an air column packing material is completed.

On the other hand, in general, when three-side packing or partial three-side packing is performed on vegetables by using an existing technology, cumbersome processes should be performed as follows: a bag-shaped packaging material is prepared ahead, a certain amount of vegetables is bound by a binding wire, a bundle of the bound vegetables is put into the bag-shaped packaging material, and the bag-shaped packaging material is sealed. However, according to the vegetable binding packing method using an air column binding packaging material according to the present disclosure, a certain amount of vegetables is supplied in a packaging material having a film shape rather than a bag shape, an air column is formed to bind the vegetables, both ends of the air column are bonded to seal the air column and concurrently bond the peripheral portions of the above-described skirt parts, by using the air column binding packaging material (see FIGS. 9 and 10) having the skirt parts extending to cover three sides or partial three sides of vegetables, thereby easily completing three-side packing or partial three-side packing through automated series of operations.

INDUSTRIAL AVAILABILITY

The present disclosure relates to a vegetable binding packing material for packing vegetables such as leeks, spinach, green onions, and Chinese cabbages in a bundle unit, a vegetable binding packing device using the same, and a vegetable binding packing method using the same. Therefore, the present disclosure may be used in packing material manufacturing industries, packing device manufacturing industries, and vegetable production and distribution industries including a vegetable packing operation.

While various embodiments have been described above, it will be understood to those skilled in the art that the embodiments described are by way of example only. Accordingly, the disclosure described herein should not be limited based on the described embodiments.

The invention claimed is:

1. A vegetable binding packing device comprising:

a packing material supply unit configured to feed a packing material having an air column pattern formed between double-layered films;

a clamp injection module having a clamping part configured to clamp a front portion of the packing material and an injection part configured to inject air into the air column pattern;

a vegetable supply unit configured to supply vegetables to be packed, to a middle portion of the packing material between the front portion and a rear portion of the packing material in a direction crossing the packing material in a state in which the front portion is supported by the clamp injection module and the rear portion is supported by the packing material supply unit; and a sealing module configured to pressurize and support the front portion and the rear portion of the packing material such that the front portion and the rear portion overlap each other with the vegetables surrounded by the middle portion of the packing material, and to seal a portion of the air column pattern across the air column pattern injected with air, wherein the sealing module comprises:

a sealing head configured to pressurize and bond overlapped portions of the packing material;

a pair of sealing guides disposed at front and rear sides of the sealing head to pressurize and support both sides of the overlapped portions; and an air blocking part disposed between the sealing head and the sealing guide at the rear side among the pair of sealing guides to pressurize and block the air column pattern before a bonding operation of the sealing head.

2. The vegetable binding packing device of claim 1, wherein the pair of sealing guides has a groove corresponding to the air column pattern, and air is injected into the air column pattern through the groove in a state in which the pair of sealing guides pressurize and support the packing material.

3. The vegetable binding packing device of claim 1, wherein the sealing head welds the overlapped portions of the packing material.

4. The vegetable binding packing device of claim 3, wherein the sealing head heat-welds the overlapped portions of the packing material and pulls back from the overlapped portions of the packing material in a state in which the pair of sealing guides and the air blocking part pressurize and support the both sides of the overlapped portions, so as to promote air cooling of the overlapped portions.

5. A vegetable binding packing device comprising:

a packing material supply unit configured to feed a packing material having an air column pattern formed between double-layered films;

a clamp injection module having a clamping part configured to clamp a front portion of the packing material and an injection part configured to inject air into the air column pattern;

a vegetable supply unit configured to supply vegetables to be packed, to a middle portion of the packing material between the front portion and a rear portion of the packing material in a direction crossing the packing material in a state in which the front portion is supported by the clamp injection module and the rear portion is supported by the packing material supply unit; and a sealing module configured to pressurize and support the front portion and the rear portion of the packing material such that the front portion and the rear portion overlap each other with the vegetables surrounded by the middle portion of the packing material, and to seal a portion of the air column pattern across the air column pattern injected with air, wherein the packing material supply unit supplies discontinuous sheet-shaped packing material or a continuous-roll-shaped packing material, and wherein, when the packing material supply unit supplies the continuous-roll-shaped packing material, the clamp injection module comprises a plurality of injection needles, each of which corresponds to an air column in the continuous-roll-shaped packing material.

6. A vegetable binding packing method comprising:

a packing material preparing operation of preparing a vegetable binding packing material comprising an air column pattern formed between double-layered films;

a packing material supplying operation of transferring the vegetable binding packing material a certain distance in a lengthwise direction of the air column pattern;

a vegetable supplying operation of supplying vegetables to a middle portion between a front portion and a rear portion of the vegetable binding packing material in a state in which the front portion and the rear portion are supported, and allowing the vegetable binding packing material to surround the vegetables in a state in which a lengthwise direction of the vegetables crosses a lengthwise direction of the vegetable binding packing material; and an air injecting and bonding operation of supporting the front portion and the rear portion of the vegetable binding packing material such that portions of the front and rear portions overlap each other, injecting air into the air column pattern to form an air column surrounding the vegetables, and bonding the overlapped portions, wherein, in the packing material preparing operation, double-layered skirt parts are formed by extending an inner film and an outer film from at least one side of the air column pattern in a widthwise direction of the air column pattern, and the outer film of the double-layered skirt parts is folded to cover an outer surface of the air column.

* * * * *